US010143315B2

(12) United States Patent
Pyle

(10) Patent No.: US 10,143,315 B2
(45) Date of Patent: Dec. 4, 2018

(54) FRAME APPARATUS

(71) Applicant: MCS Industries, Inc., Easton, PA (US)

(72) Inventor: Michael Lee Pyle, Sugar Grove, IL (US)

(73) Assignee: MCS INDUSTRIES, INC.

( * ) Notice: Subject to any disclaimer, the term of this patent is extended or adjusted under 35 U.S.C. 154(b) by 0 days.

(21) Appl. No.: 15/481,822

(22) Filed: Apr. 7, 2017

(65) Prior Publication Data

US 2017/0290449 A1 Oct. 12, 2017

Related U.S. Application Data

(60) Provisional application No. 62/319,851, filed on Apr. 8, 2016.

(51) Int. Cl.
*A47G 1/10* (2006.01)
*A47G 1/16* (2006.01)
(Continued)

(52) U.S. Cl.
CPC ..... *A47G 1/1626* (2013.01); *A47G 1/0611* (2013.01); *A47G 1/08* (2013.01); *A47G 1/10* (2013.01); *A47G 1/202* (2013.01)

(58) Field of Classification Search
CPC ..... A47G 1/1626; A47G 1/0611; A47G 1/08; A47G 1/06; A47G 1/202; A47G 1/10; A47G 1/0605; G09F 1/12; G09F 15/0012
(Continued)

(56) References Cited

U.S. PATENT DOCUMENTS 4,171,117 A 10/1979 Prochaska
4,216,597 A * 8/1980 Kocina ..... A47G 1/0605 248/496
(Continued)

FOREIGN PATENT DOCUMENTS

DE 19900723 9/1999

OTHER PUBLICATIONS

Under the Roof Decorating, "How to Attach a Sawtooth Hook to a Frame" [online] (retrieved from the internet on Jul. 24, 2018) <URL http://www.utrdecorating.com/blog/how-to-attach-a sawtooth-hook-to-a-frame/>, Nov. 11, 2016 (Nov. 11, 2016); entire document, especially Figs. 1-2. US.
(Continued)

*Primary Examiner* — Nkeisha Smith
(74) *Attorney, Agent, or Firm* — Belles Katz LLC

(57) ABSTRACT

A frame apparatus for displaying an article. The frame apparatus includes a frame having a rabbet and a channel having a channel axis formed into a wall of the rabbet. A stack is positioned within the rabbet for display. The stack may include a glazing, an article for display, and a backer panel. A clip member is slidably coupled to the frame within the channel such that the clip member can slide within the channel along the channel axis while remaining coupled to the frame. The clip member has a hanging feature. Thus, the clip member serves the dual purpose of securing the stack within the rabbet and also providing the hanging feature for the frame. Furthermore, the clip member functions as a built-in self-leveling feature because it can slide within the channel thus ensuring that the frame is hung in a level manner.

14 Claims, 32 Drawing Sheets

(51) Int. Cl.
*A47G 1/06* (2006.01)
*A47G 1/08* (2006.01)
*A47G 1/20* (2006.01)

(58) Field of Classification Search
USPC .... 248/495, 496, 497, 466, 475.1, 477, 488, 248/317, 339, 468, 470, 471, 473, 476, 248/478, 480; 40/792, 761, 759, 741, 40/790, 791, 766
See application file for complete search history.

(56) References Cited

U.S. PATENT DOCUMENTS 4,420,138 A * 12/1983 Sobel ..... A47G 1/162 248/496
4,428,135 A * 1/1984 Sobel ..... A47G 1/10 40/759
4,458,873 A * 7/1984 Sutherland ..... A47G 1/162 206/499
RE31,799 E * 1/1985 Paskerian ..... A47G 1/06 248/489
4,571,866 A * 2/1986 Cole ..... A47G 1/162 248/496
4,641,441 A * 2/1987 Roth ..... A47G 1/0605 248/496
4,645,165 A 2/1987 Raap
4,704,814 A * 11/1987 Astolfi ..... A47G 1/142 248/473
5,303,895 A * 4/1994 Hart ..... A47G 1/168 248/475.1
5,335,434 A * 8/1994 Shultz ..... A47G 1/0605 40/746
5,441,338 A 8/1995 Kane et al.
5,947,438 A 9/1999 Lemire
6,241,210 B1 6/2001 Brindisi
6,527,244 B1 3/2003 Kamenstein et al.
6,962,016 B1 * 11/2005 Meyer ..... A47G 1/0605 40/700
7,762,517 B1 7/2010 Leseman
8,458,943 B2 6/2013 Home
9,279,538 B1 3/2016 Wening
2006/0218839 A1 10/2006 Vineyard
2007/0051023 A1 3/2007 Bravo
2010/0011602 A1 1/2010 Houssian et al.
2013/0180142 A1 7/2013 Kressin et al.
2013/0247401 A1 9/2013 Miller
2014/0026456 A1 * 1/2014 Pirayesh ..... A47G 1/0605 40/741
2014/0231611 A1 8/2014 Svihilik

OTHER PUBLICATIONS

International Search Report for Corresponding Application No. PCT/US18/35122, dated Aug. 23, 2018. WO.

* cited by examiner

FRAME APPARATUS

CROSS-REFERENCE TO RELATED APPLICATIONS

The present application claims the benefit of U.S. Provisional Patent Application No. 62/319,851, filed Apr. 8, 2016, the entirety of which is hereby incorporated by reference.

FIELD OF THE INVENTION

The present invention relates generally to a frame apparatus and more specifically to a frame apparatus having a frame and a clip member slidably coupled thereto.

BACKGROUND OF THE INVENTION

People often commemorate their achievements or memorialize particular life events by placing an article within a frame for display. Specifically, individuals may frame a diploma for hanging on a wall in their office space. Individuals may also frame various photographs for display throughout their home and offices spaces by either hanging such frames on the wall or allowing such frames to stand upright on a horizontal surface such as a desk or table. Furthermore, people often hang mirrors from a wall and there is a noted difficulty in hanging mirrors from a wall in a level manner. Frames generally require turn buttons, flex tabs, or glazier points to secure the article to be framed within the rabbet of the frame. Frames also, and separately, require hanger elements that are secured to the frame and that permit the frame to be hung from a vertical surface such as a wall. Using one component to secure articles within the flame and a second different component to hang the frame from a wall makes frames more expensive than necessary to manufacture and more difficult than necessary to use. Furthermore, using conventional hanger elements it can be difficult for a user to hang a frame from a vertical surface such as a wall in a level manner. Thus, a need exists for a frame apparatus having a component that can both secure articles to the frame and be used for hanging the frame from a wall. A need also exists for a frame apparatus having a component that can ensure that the frame is hung in a level manner.

BRIEF SUMMARY OF THE INVENTION

The present invention is directed to a frame apparatus for displaying an article. The frame apparatus includes a frame having a rabbet and a channel having a channel axis formed into a wall of the rabbet. A stack is positioned within the rabbet for display. The stack may include a glazing, an article for display, and a backer panel. A spring clip is slidably coupled to the frame within the channel such that the spring clip can slide within the channel along the channel axis while remaining coupled to the frame. The spring clip has a hanging feature. Thus, the spring clip serves the dual purpose of securing the stack within the rabbet and also providing the hanging feature for the frame. Furthermore, the spring clip functions as a built-in self-leveling feature because it can slide within the channel thus ensuring that the frame is hung in a level manner.

In one embodiment, the invention may be a frame apparatus for displaying an article, the frame apparatus comprising: a frame comprising: an inner surface defining a display opening; and a rabbet defined by a floor and a wall of the frame a channel formed into the wall: a stack comprising a front surface and an opposite rear surface positioned in the rabbet and extending across the display opening; a spring clip slidably coupled to the frame within the channel and trapping the stack between the spring clip and the floor of the rabbet, the spring clip comprising a hanging feature for hanging the frame; and wherein the spring clip comprises a base portion, a first leg extending from the base portion to a distal end, and a second leg extending from the base portion to a distal end, the distal ends of the first and second legs positioned within the channel to slidably couple the spring clip to the frame.

In another embodiment, the invention may be a frame apparatus for displaying an article, the frame apparatus comprising a frame having a front surface and an opposite rear surface, the frame comprising: an inner surface defining a display opening; a rabbet defined by a floor and a wall of the frame; and a channel formed into the wall and defined by a bottom surface, a top surface, and a sidewall surface; a stack positioned in the rabbet and extending across the display opening; and a clip member slidably coupled to the frame with a first portion of the clip member located within the channel and a second portion of the clip member protruding from the channel, wherein the stack is compressed between the second portion of the clip member and the floor of the rabbet, the second portion of the clip member having a hanging feature for hanging the frame.

In still another embodiment, the invention may be a frame apparatus for displaying an article, the frame apparatus comprising: a frame comprising: an inner surface defining a display opening; and a rabbet defined by a floor and a wall of the frame, a channel formed into the wall, the channel comprising at least one linear section extending along an axis; a stack positioned in the rabbet and extending across the display opening; first and second clip members slidably coupled to the channel of the frame so that the stack is positioned between the first and second clip members and the floor of the rabbet, the first and second clip members having a hanging feature for hanging the frame from a surface: and wherein the first and second clip members comprise first portions that are located within the same linear section of the channel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1A:
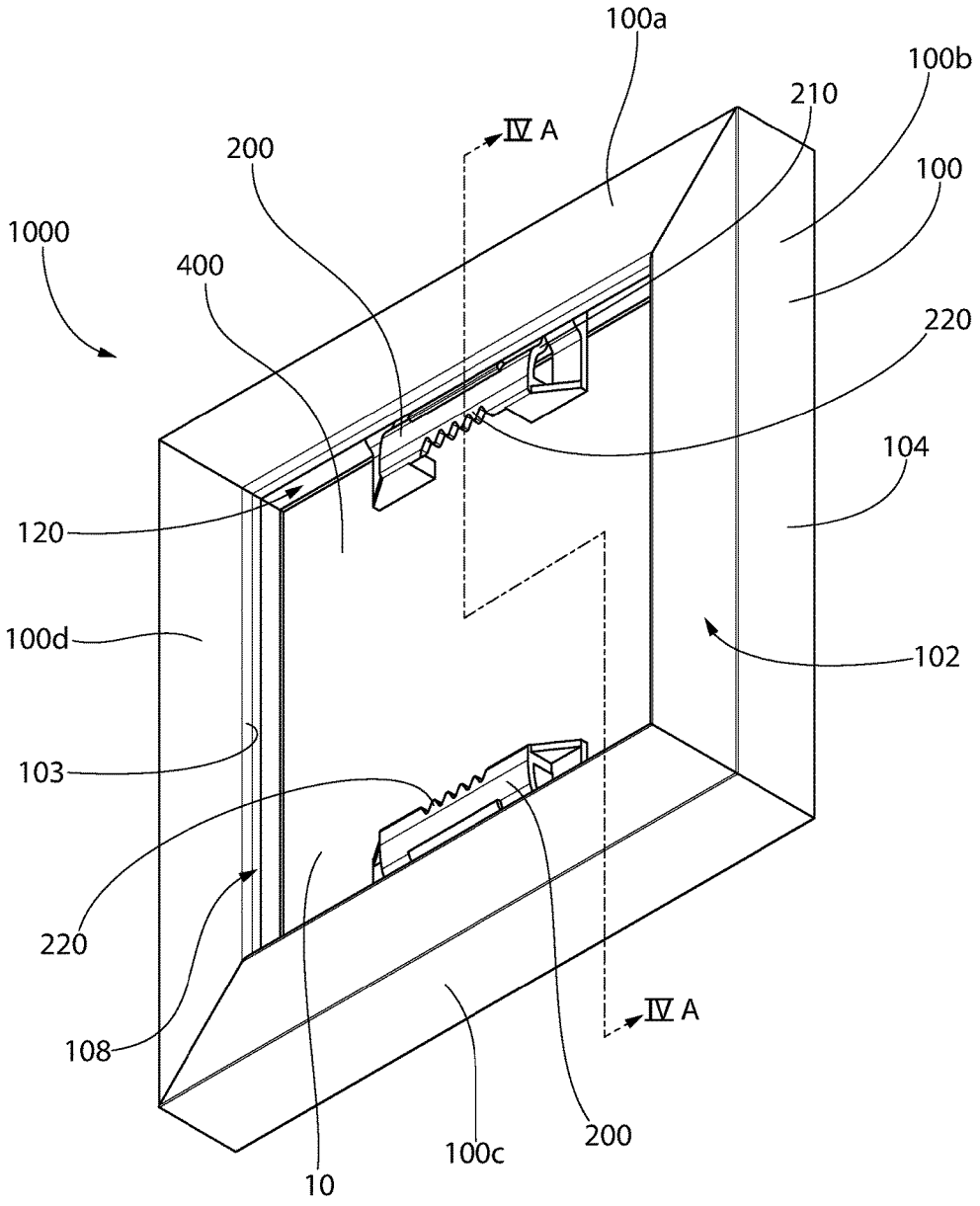
FIG. 1A is a rear perspective view of a frame apparatus having a frame and a clip member coupled thereto in accordance with an embodiment of the present invention.
Figure 1B:
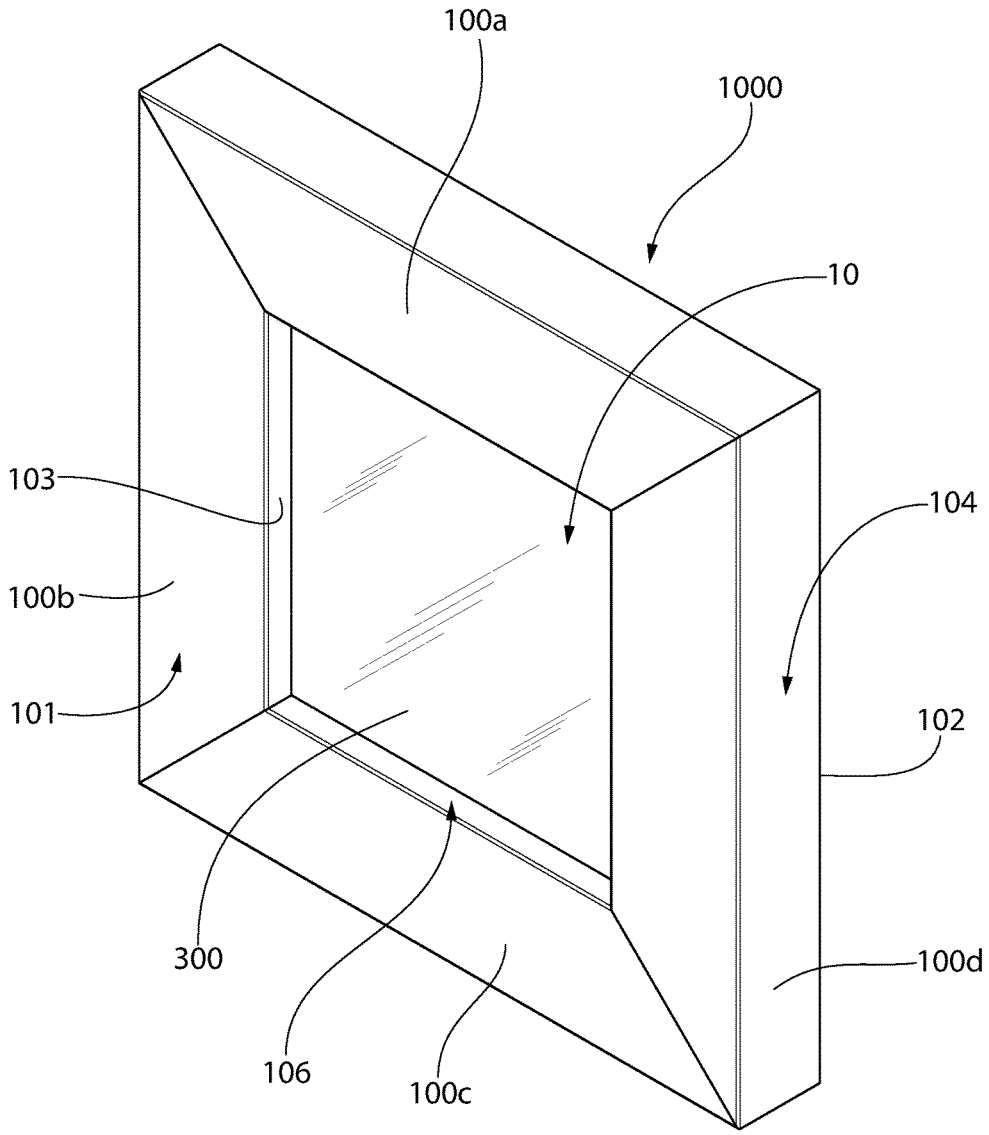
FIG. 1B is a front perspective view of the frame apparatus of FIG. 1A

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to he considered part of the entire written description. In the description of embodiments of the invention disclosed herein, any reference to, direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1A, 1B, 2, 4A, and 4B concurrently, a frame apparatus 1000 will be described in accordance with an embodiment of the present invention. The frame apparatus 1000 generally comprises a frame 100, a plurality of clip members 200, and a stack 10 that is intended to be framed by the frame 100. In the exemplified embodiment, the stack. 10 comprises a glazing 300, a backer panel 400, and an article 500 that is being displayed by the frame 100. The stack 10 may also comprise additional components, such as a filler panel or the like, as may be needed to ensure that the stack 10 is sufficiently secured within the frame 100 to facilitate a consistent display of the article 500. Although the glazing 300 and the backer panel 400 are illustrated in the exemplified embodiment, these features are not necessary in all embodiments and may be omitted or replaced with similar structures. For example, in some embodiments the frame apparatus 1000 may include two glazings, one on the front and one on the rear that replaces the backer panel 400. Furthermore, the stack 10 may merely comprise the article 500 without the glazing 300 and the backer panel 400. Further still, in some embodiments the stack 10 may comprise a mirror.

The glazing 300 can be any type of material that is used as a protective and see-through covering for a framed article. In certain embodiments, the glazing 300 is a panel of glass, acrylic, plexiglass, polystyrene or other material that allows the article 500 to be viewed through the glazing 300. Thus, in certain embodiments the glazing 300 is formed of a substantially transparent material so that the article(s) 500 being framed therein are visible through the glazing 300. As used herein, the term "transparent" may include the presence of colored tint and thus is not limited to a clear material. In other embodiments, the glazing 300 may be at least partially translucent. In still other embodiments of the invention, the glazing 300 may be omitted from the frame apparatus 1000.

The backer panel 400 can be formed of hard or soft plastic materials, such as any of the thermoplastics including polymers and copolymers of ethylene, propylene (i.e., polypropylene), olefins, butadiene, vinyl compounds and polyesters. Alternatively, the backer panel 400 can be formed of a cardboard, wood, metal or other material as desired. In certain embodiments, the backer panel 400 may be a ring-like structure rather than a sheet-like structure. The backer panel 400 serves as a tiller to ensure that the stack 10 adequately fills the rabbet 110 space so that the stack is securely held within the frame 100. The backer panel 400 also provides protection to the back/rear of the article 500 that is being framed.

In some embodiments, the frame apparatus 1000 may also include a filler panel between the backer panel 400 and the article 500. In such embodiments, the filler panel takes up space and reduces potential damage by adding a layer of protection for the article 500. The filler panel can also be used to provide the necessary thickness to the stack 10 to ensure adequate compression to hold the stack in the frame 100 as discussed herein below. The filler panel may be a sheet of corrugated material or other medium, such as a corrugated metal, corrugated cardboard, plastic, fiberboard (i.e., medium density fiberboard (MDF)) or the like. The filler panel can be included with the frame apparatus 1000 or omitted as desired. Furthermore, the backer panel 400 may be omitted in some embodiments as well.

The article 500 may be any object that is desired to be held by and displayed within the frame 100. Thus, the article 500 may be a flat article such as a poster or print having a design or indicia thereon. Alternatively, the article 500 may be a three-dimensional object that a person desires to frame for display. The article 500 may alternatively be a mirror that is surrounded by the frame 100. Thus, the article 500 may be any object that is conventionally framed by persons desiring to display that article.

Figure 2:
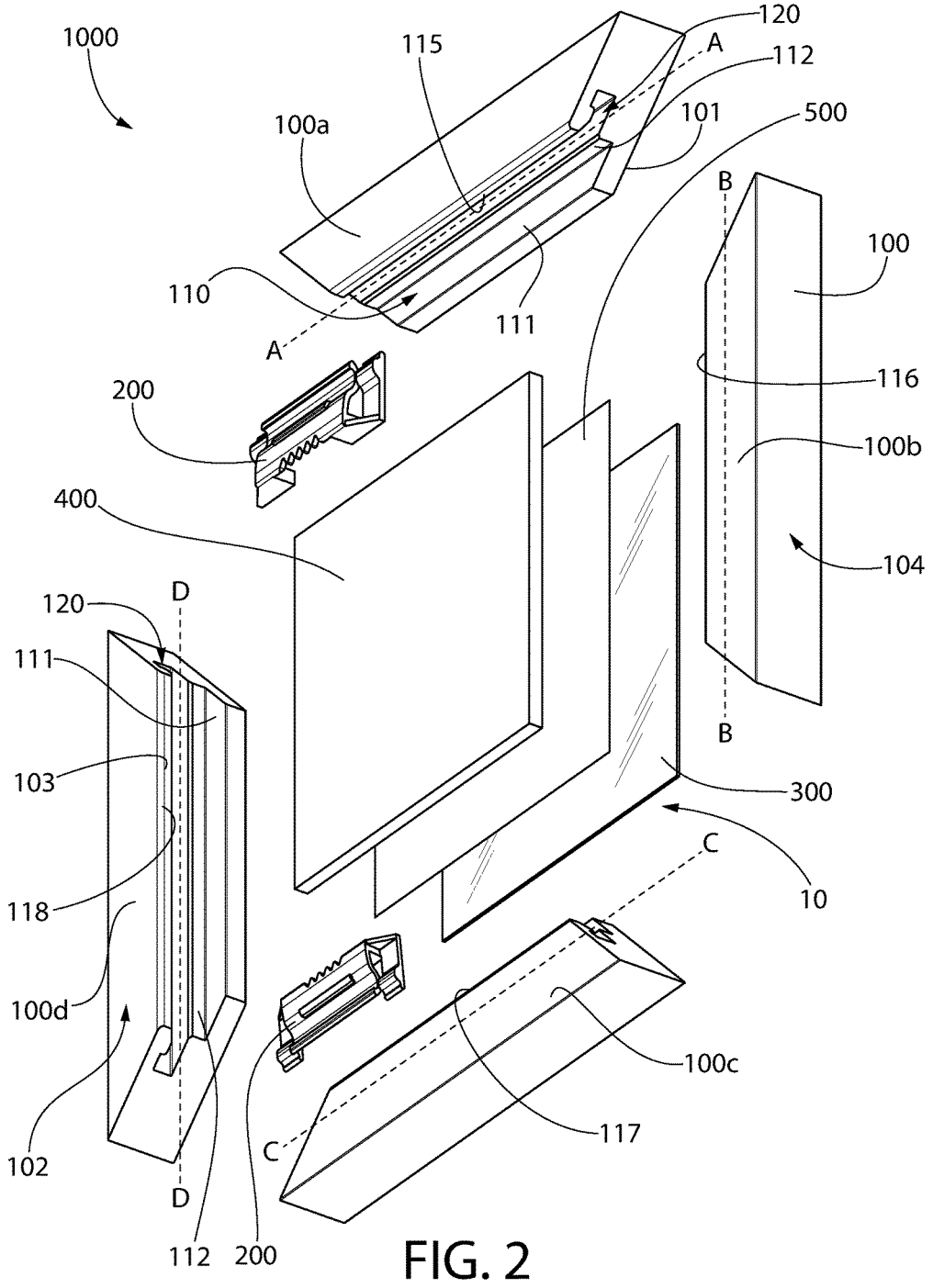
FIG. 2 is an exploded view of the frame apparatus of FIG. 1A.

In certain embodiments, the frame apparatus 1000 may be best suited for being hung from a vertical surface such as a wall. However, the invention is not intended to be so limited in all embodiments and it may be displayed in any manner currently used to display frames. In FIG. 2, the frame 100 is illustrated comprising four separate frame components 100*a-d* (a first frame component 100*a*, a second frame component 100*b*, a third frame component 100*c*, and a fourth frame component 100*d*) each having both of its opposing ends cut to approximately 45° so that when the frame components 100*a-d* are coupled together a miter joint is formed. Of course, the invention is not to be so limited and in other embodiments the frame 100 may comprise a single piece structure. In the exemplified embodiment, the frame 100 is square or rectangular shaped and has four side elements. Of course, the invention is not to be so limited and in other embodiments the frame may take on any desired shape, including triangular having three side elements, pentagonal having five side elements, hexagonal having six side elements, heptagonal having seven side elements, octagonal having eight side elements, and so forth. Thus, the inventive concepts described herein may be used with frames 100 having various shapes and sizes.

The frame 100 may be an integrally formed single component formed by injection molding, machining, milling, or the like. Alternatively, the frame 100 may be formed of an extruded polymer such as a general purpose polystyrene, in other embodiments the frame 100 may be co-extruded from expanded polystyrene such as polystyrene foam and a general purpose polystyrene. In other embodiments, the frame 100 but may also be formed of wood, medium-density fiberboard, metal, metal alloys, plastics, rubbers, or combinations thereof, etc. Thus, the invention is not to be limited by the material used to form the frame unless expressly stated otherwise herein.

Figure 10:
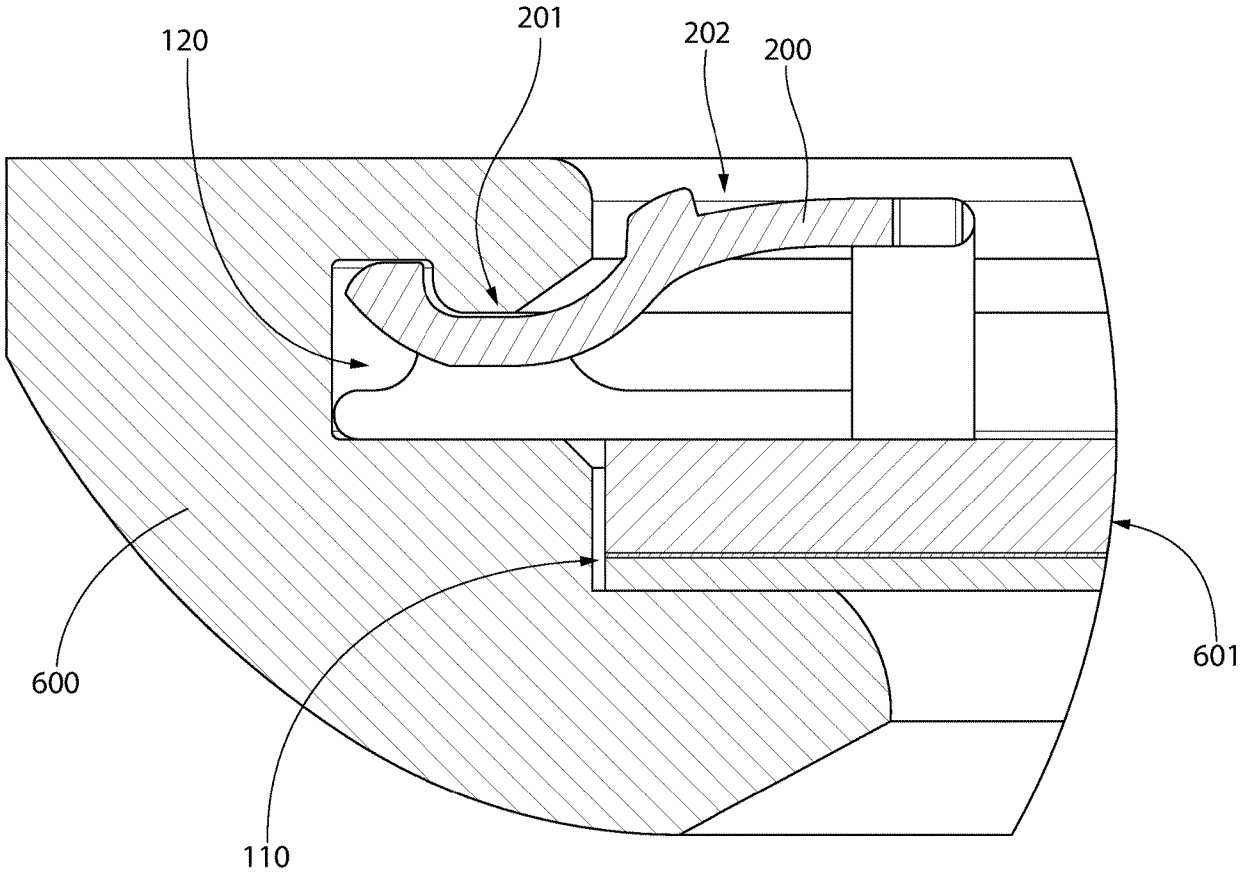
FIG. 10 is a close-up cross-sectional view taken along line IVB of FIG. 4A illustrating an alternative profile for the frame.

The frame 100 generally comprises a front surface 101, a rear surface 102, an inner surface 103 extending between the front and rear surfaces 101, 102, and an outer surface 104 extending between the front and rear surfaces 101, 102. The inner surface 103 of the frame 100 defines a display opening 106 for the frame 100 adjacent the front surface 101 of the frame 100 through which the article 500 can be viewed. The rear surface 102 of the frame 100 is the surface that is adjacent to a wall when the frame 100 is hung from the wall and the front surface 101 of the frame 100 is the surface that is exposed for viewing by a viewer. The front surface 101 and the outer surface 104 of the frame 100, which are exposed to a viewer, may take on any desired shape or profile to create a desired aesthetic. Thus, the front surface 101 and the outer surface 104 may be flat and planar as illustrated in FIGS. 1A-2 or they may be rounded, contoured, sculpted or profiled in a specific manner, or the like (one alternative example is illustrated in FIG. 10).

As will be discussed in greater detail below, the frame 100 has a rabbet 110 formed into the inner edge 103. The rabbet 110 is defined by a floor 111 and a wall 112 of the frame 100 that extends from the floor 111 to the rear surface 102 of the frame 100. The floor 111 of the rabbet 110 is recessed from the front surface 101 of the frame 100. The rabbet 110 forms a ledge onto which the glazing 300, the article 500, and the backer panel 400 (collectively referred to herein as the stack 10) are positioned or nested in the fully assembled frame apparatus 1000. Specifically, the rabbet 110 forms an annular ledge upon which the stack 10 may be positioned to frame the stack 10 (and particularly the article 500 thereof). The term "annular" as used herein does not refer specifically to a circular shape, but refers to a ring-like structure forming a closed geometry regardless of the specific shape of the ring, whether it is circular, square, rectangular, or other geometric forms. Furthermore, the term "annular" may also include a discontinuous ring-like structure of various shapes and thus the floor 111 and the ledge formed thereby need not be continuous in its extension in all embodiments.

The stack 10 has a front surface 11 and an opposite rear surface 12. The front surface 11 of the stack 10 is exposed through, the display opening 106 and the rear surface 12 of the stack 10 is not exposed when the frame 100 is hung from a wall or other surface. In the exemplified embodiment, the glazing 300 forms the front surface 11 of the stack 10 and the backer panel 400 forms the rear surface 12 of the stack 10. Of course, depending on the specific components that make up the stack 10, this may be different in other embodiments. To assemble the frame apparatus 1000, a perimeter portion of the glazing 300 is positioned directly atop the floor surface 111 of the rabbet 110, and then the article 500 is positioned atop the glazing 300 and the backer panel 400 is positioned atop the article 500.

In the exemplified embodiment, the components of the stack 10 are inserted into the rabbet 10 via an opening 108 in the rear surface 102 of the frame 100. Thus, the frame 100 in the exemplified embodiment is a rear mounted frame, meaning that the article 500 (and the stack 10 generally) is mounted by inserting it through the opening 108 in the rear surface 102 of the frame 100. The invention is not to be so limited in all embodiments and it is possible that in an alternative embodiment a frame using a front mount assembly may be used in accordance with the teachings set forth herein. In the exemplified embodiment, the opening 108 in the rear surface 102 of the frame 100 is larger in at least one dimension than the display opening 106 in the front surface 101 of the frame. Thus, the stack 10 is prevented from passing into and through the display opening 106 by the floor 111 of the rabbet 110.

As seen in FIG. 2, each frame component 100*a-d* of the frame 100 has a portion of the rabbet 110 formed therein. When the frame components 100*a-d* are coupled together as described herein, the rabbets 110 of each frame component 100*a-d* are aligned with one another to form the rabbet 110 of the frame 100. The rabbet 110 of the frame 100 in its fully assembled state circumscribes the display opening 106.

The frame 100 also comprises a channel 120 formed into the wall 112 of the rabbet 110. The channel 120 is formed by an elongated notch or cutout in the wall 112 of the rabbet 110. Similar to the rabbet 110, the channel 120 is formed into each frame component 100*a-d*, and when the frame components 100*a-d* are coupled together to form the frame 100, a single continuous channel 120 is formed that circumscribes the display opening 106. In the exemplified embodiment, the channel 120 extends the entire length of the rabbet 110 within each of the frame components 100*a-d*, and thus the channel 120 is a closed geometry channel. Of course, the invention is not to be so limited in all embodiments and the channel 120 may only extend part of the length of the rabbet 110 in other embodiments. The channel 120 is defined by a top surface 121, a bottom surface 123, and a sidewall surface 122 extending between the top and bottom surfaces 121 123. In the exemplified embodiment, the top and bottom surfaces 121, 123 of the channel 120 are parallel to each other and to the floor 111 of the rabbet 110 whereas the sidewall surface 122 of the channel 120 is parallel to the wall 112 of the rabbet 110.

The frame 100 comprises a protrusion 124 extending from the top surface 121 and into the channel 120 towards the bottom surface 123. In the exemplified embodiment, the protrusion 124 extends along the entirety of the length of the channel 120. The protrusion 124 has a leading edge 130 adjacent the inner surface 103 of the frame 100 and an opposite trailing edge 131. The leading edge 130 comprises a chamfer 125 that interacts with the clip member 200 during coupling of the clip member 200 to the frame 100 as described herein below. The trailing edge 131 is spaced apart from the sidewall surface 122 of the channel 120 by a gap 126 that forms a pocket for mounting of the clip member 200 to the frame 100 as described in more detail below. Once installed, the clip member 200 interacts with/engages the trailing edge 131 of the protrusion 124 to maintain the coupling between the clip member 200 and the frame 100.

The inner edge 103 of the frame 100 comprises a first inner edge portion 115 formed into the first frame component 100*a* of the frame 100, a second inner edge portion 116 formed into the second frame component 100*b* of the frame 100, a third inner edge portion 117 formed into the third frame component 100*c* of the frame 100, and a fourth inner edge portion 118 formed into the fourth frame component 100*d* of the frame 100. When the frame 100 is formed of a single piece rather than separate components, the different inner edge portions noted above are simply the upper, lower, left-side, and right-side inner edge portions. The first inner edge portion 115 comprises a first linear section of the channel 120 that extends along a first axis A-A, The second inner edge portion 116 comprises a second linear section of the channel 120 that extends along a second axis B-B. The third inner edge portion 117 comprises a third linear section of the channel 120 that extends along a third axis C-C. The fourth inner edge portion 118 comprises a fourth linear section of the channel 120 that extends along a fourth axis D-D. These sections of the channel 120 and axes will be used later to describe the slidability of the clip member 200 when the clip member 200 is coupled or mounted to the frame 100 within the channel 120.

During assembly of the frame apparatus 1000, the clip members 200 are coupled to the frame 100 after the stack 10 is positioned in the rabbet 110. This is because the clip members 200 are used to secure/retain the stack 10 within the rabbet 110 in place of turn buttons, flex tabs, or other components that are generally used for this purpose. Each of the clip members 200 is coupled to the frame 100 within one of the linear sections of the channel 120 while permitting the clip members 200 to be slidable within that linear section of the channel 120 along its axis A-A, B-B, C-C, D-D. Thus, the clip members 200 can slide side-to-side within the linear section of the channel 120 that they are coupled to, which helps with hanging the frame 100 in a level manner as discussed below.

As discussed in more detail herein below, the clip members 200 secure the stack 10 within the rabbet 110 by sandwiching the stack 10 between the floor 111 of the rabbet 110 and the clip members 200. Furthermore, the clip members 200 comprise a hanging feature 220 for hanging the frame 100 from a desired surface., such as a wall. The clip members 200 are configured to slide within the channel 120 along one of the axes A-A-, B-B, C-C, D-D (the one that corresponds to the linear section of the channel 120 that the clip member 200 is mounted to) to function as a self-leveling feature to ensure that the frame 100 is hung at a desired orientation.

Figure 3A:
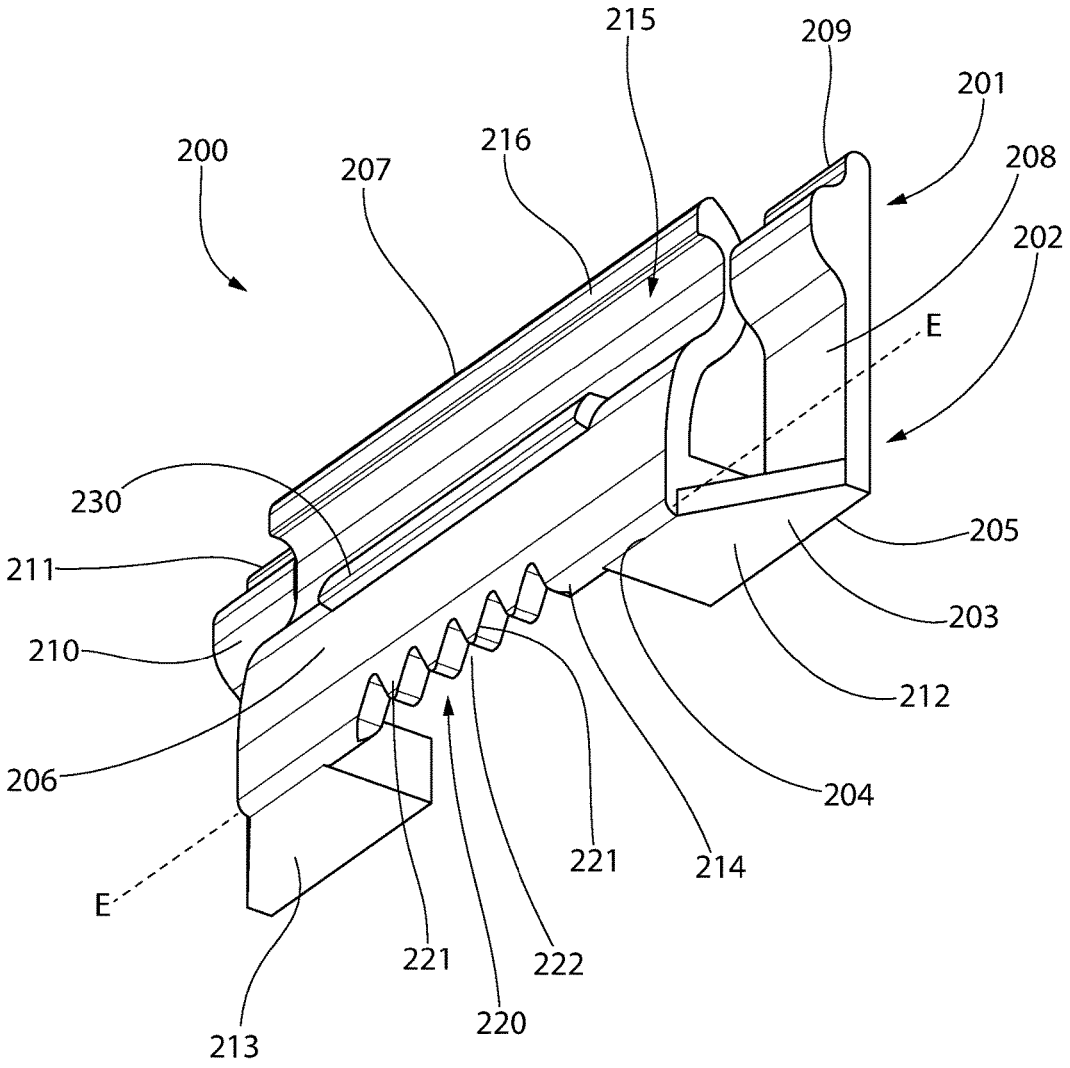
FIG. 3A is a top perspective view of the clip member of FIG. 1A.
Figure 3B:
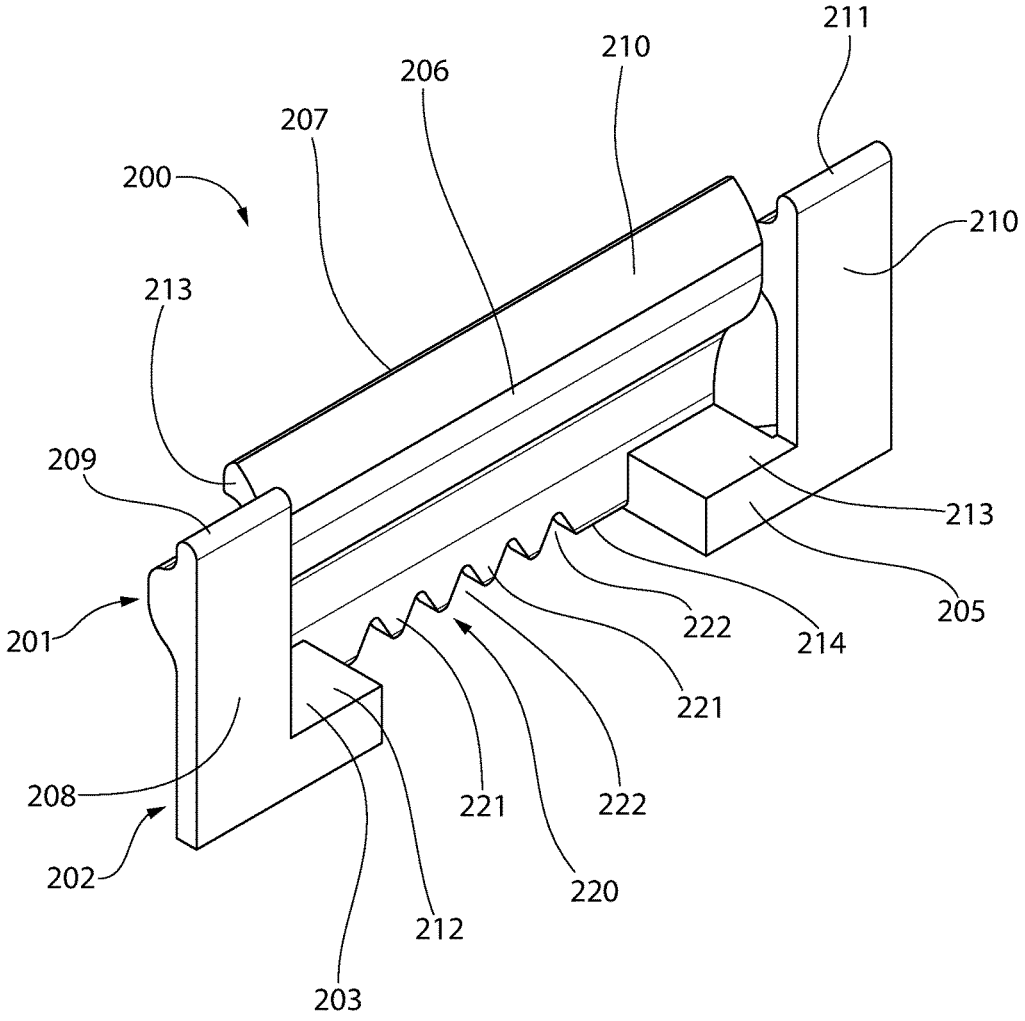
FIG. 3B is a bottom perspective view of the clip member of FIG. 1A.

Referring now to FIGS. 1, 3A, and 3B concurrently, the clip member 200 will be further described. The clip member 200 may be formed of plastic (including polystyrene or otherwise) or metal, but the material of the clip member 200 is not intended to be limiting of the present invention embodiments. In certain embodiments the clip member 200 may be a spring clip such that it has flexibility when a force is applied thereon as described herein but is biased into its original shape when no force is applied thereon. In the exemplified embodiment, the clip member 200 is biased into the shape/position illustrated in FIGS. 3A and 3B. The clip member 200 can flex when pressures are applied thereto to facilitate coupling of the clip member 200 to the frame 100. In the exemplified embodiment, the clip member 200 is configured to be coupled to the frame 100 by snap-fitting the clip member 200 into the channel 120. The details of this process will be described in detail below with reference to FIGS. 6A-6E.

The clip member 200 generally comprises a first portion 201 and a second portion 202. The first portion 201 of the clip member 200 is located within the channel 120 when the clip member 200 is coupled to the frame 100 and the second portion 202 of the clip member 200 protrudes from or extends out of the channel 120 when the clip member 200 is coupled to the frame 100. Thus, the first portion 201 of the clip member 200 is the portion that is located within the channel 120 and the second portion 202 of the clip member 200 is the portion that is not located within the channel 120. The second portion 202 of the clip member 200 comprises the hanging feature 220 of the clip member 200.

The clip member 200 comprises a base portion 203 having a top surface 204 and an opposite bottom surface 205, a first leg 206 extending from the base portion 203 to a distal end 207, a second leg 208 extending from the base portion 203 to a distal end 209, and a third leg 210 extending from the base portion 203 to a distal end 211. In some embodiments the third leg 210 may be omitted. The first portion 201 of the clip member 200 comprises a portion of each of the first, second, and third legs 206, 208, 210 that includes the distal ends 207, 209, 211 of the first, second, and third legs 206, 208, 210. Thus, the distal ends 207, 209, 211 of the first, second, and third legs 206, 208, 210 are positioned within the channel 120 when the clip member 200 is coupled to the frame 100. The second portion 202 of the clip member 200 comprises the remaining portion of each of the fast, second, and third legs 206, 208, 210 as well as the base portion 203 of the clip member 200. Thus, the base portion 203 of the clip member 200 is external to the channel 120 when the clip member 200 is coupled to the frame 100.

The distal ends 207, 209, 211 of the first, second, and third legs 206, 208 210 are the free ends of the first, second, and third legs 206, 208, 210 that are unattached to one another or to another structure. Thus, each of the first, second, and third legs 206, 208, 210 is cantilevered from the base portion 203 to its respective distal end 207, 209, 211. If the clip members 200 were considered to have a "U" shape, the bight portion of the "U" that is formed by the base portion 203 of the clip member 200 is located outside of the channel 120 when the clip member 200 is coupled to the frame 100. In the exemplified embodiment, the first leg 206 extends from the base portion 203 at a location adjacent to the top surface 204 of the base portion 203 and the second and third legs 208, 210 extend from the base portion 203 at a location adjacent to the bottom surface 205 of the base portion 203.

In the exemplified embodiment, the base portion 203 comprises a first section 212 and a second section 213 that are spaced apart from one another. The second leg 208 extends from the base portion 203 adjacent the bottom surface 205 of the first section 212 of the base portion 203 and the third leg 210 extends from the base portion 203 adjacent the bottom surface 205 of the second section 213 of the base portion 203. Thus, the second and third legs 208, 210 are spaced apart from one another along a length of the clip member 200. The first leg 206 extends from both of the first and second sections 212, 213 of the base portion 203 and is located between the second and third legs 208, 210. Thus, the second leg 208 is located on one side of the first leg 206 and the third leg 210 is located on an opposite side of the first leg 206. The first leg 206 can flex pivot into the space between the second and third legs 208, 210 and may do so during coupling of the clip member 200 to the frame 100.

The first leg 206 extends from both of the first and second sections 212, 213 of the base portion 203 adjacent to the top surface 204 of the base portion 203. The first leg 206 therefore also extends between the first and second sections 212, 213 of the base portion 203 and in fact serves as the structure that couples the first and second sections 212, 213 of the base portion 203 together. The first leg 206 has an exposed edge 214 extending between the first and second sections 212, 213 of the base portion 203. The exposed edge 214 is an opposite edge from the distal end 207 of the first leg 206. The exposed edge 214 of the first leg 206 comprises the hanging feature 220 of the clip member 200.

In the exemplified embodiment, the hanging feature 220 of the clip member 200 is in the form of a sawtooth hanger. Specifically, the hanging feature 220 of the clip member 200 comprises a plurality of teeth 221 and a plurality of notches 222 arranged in an alternating manner along the exposed edge 214. Thus, each pair of adjacent teeth 221 is spaced apart by one of the notches 222 and vice versa. When it is desired to hang the frame 100 with the clip member 200 mounted thereto from a hanging element (i.e., nail, screw, or the like) protruding from a wail, the hanging element is positioned within one of the notches 222 of the hanging feature 220. The use of sawtooth hangers is conventionally understood by consumers and persons skilled in the art. Furthermore, although the hanging feature 220 is a sawtooth hanger in the exemplified embodiment, the invention is not to be so limited and other types of hangers can be used including D-rings, hooks, wires, adhesive strips, plates with apertures therein, or the like, The first leg 206 of the clip member 200 comprises a depression 215 having a concave floor. The depression 215 is elongated along the first leg 206 in a direction between the second and third legs 208, 210. Thus, if the first leg 206 extends from the base portion 203 in a first direction, the depression 215 is elongated in a second direction that is, orthogonal to the first direction. As discussed in more detail below, the depression 215 of the first leg 206 is sized and shaped to receive the protrusion 124 therein to secure the clip member 200 to the frame 100. The first leg 206 has a distal portion 216 extending from the depression 215 to the distal end 207, the distal portion 216 including the distal end 207. As discussed below, the distal portion 216 forms a hook-like member that nests within the gap 126 between the protrusion 124 and the sidewall surface 122 of the channel 120 when the clip member 200 is coupled to the frame 100 The distal portion 216 of the first leg 206 of the clip member 200 interacts with the trailing edge 131 of the protrusion 124 to prevent accidental detachment of the clip member 200 from the frame 100.

At least one of the first leg 206 or the second and third legs 208, 210 of the clip member 200 is pivotable relative to the base portion 203 of the clip member 200. Specifically, the first leg. 206 may be pivotable relative to the base portion 203 about a pivot axis E-E. The second and third legs 206, 208 may additionally, or alternatively, be pivotable relative to the base portion 203 about a pivot axis that is parallel to the pivot axis E-E. This permits the first leg 206 to pivot downwardly in a direction towards the bottom end 205 of the base portion 203 and into the gap between the second and third legs 208, 210 during coupling of the clip member 200 to the frame 100. Additionally or alternatively, this allows the second and third legs 208, 210 to pivot upwardly in a direction towards the top end 204 of the base portion 203 during coupling of the clip member 200 to the frame 100.

Figure 3C:
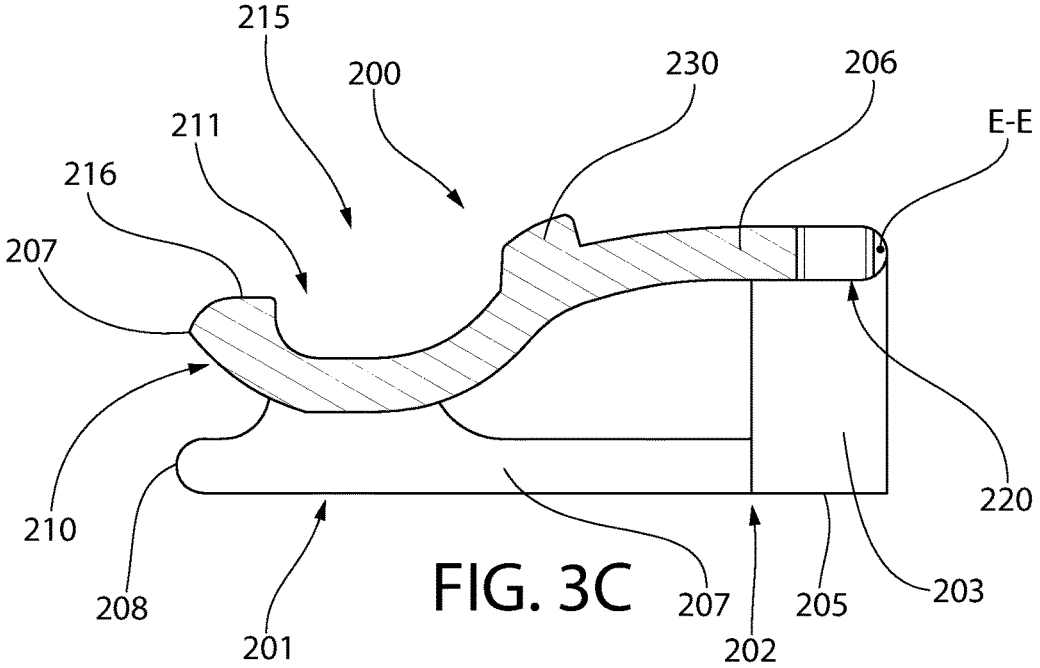
FIG. 3C is a cross-sectional schematic view of the clip member of FIG. 1A in a non-flexed state.
Figure 3D:
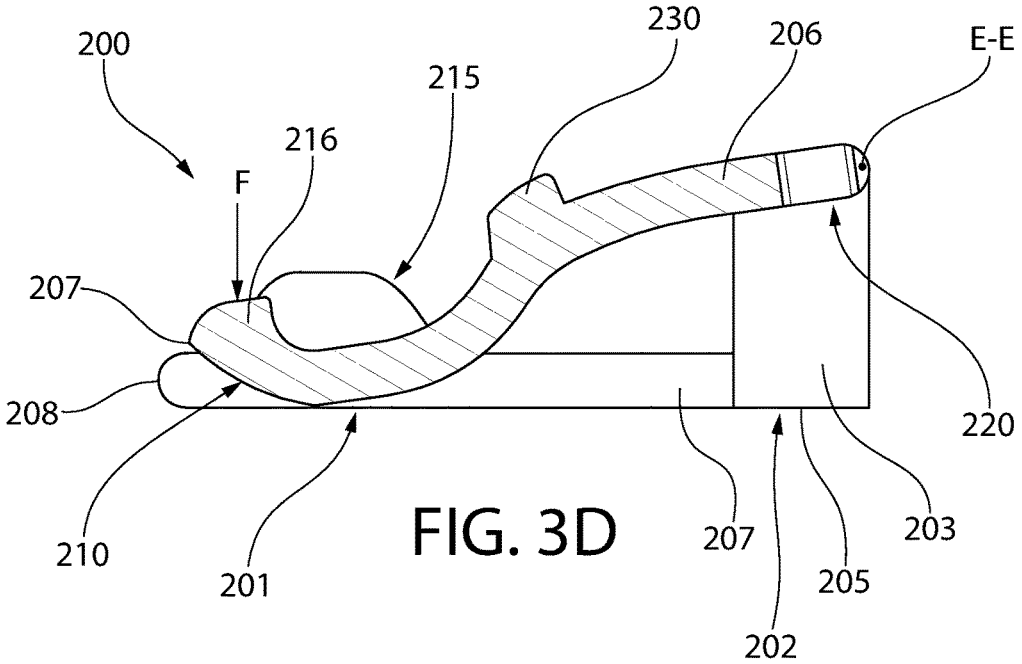
FIG. 3D is a cross-sectional schematic view of the clip member of FIG. 1A in a flexed state.
Figure 4A:
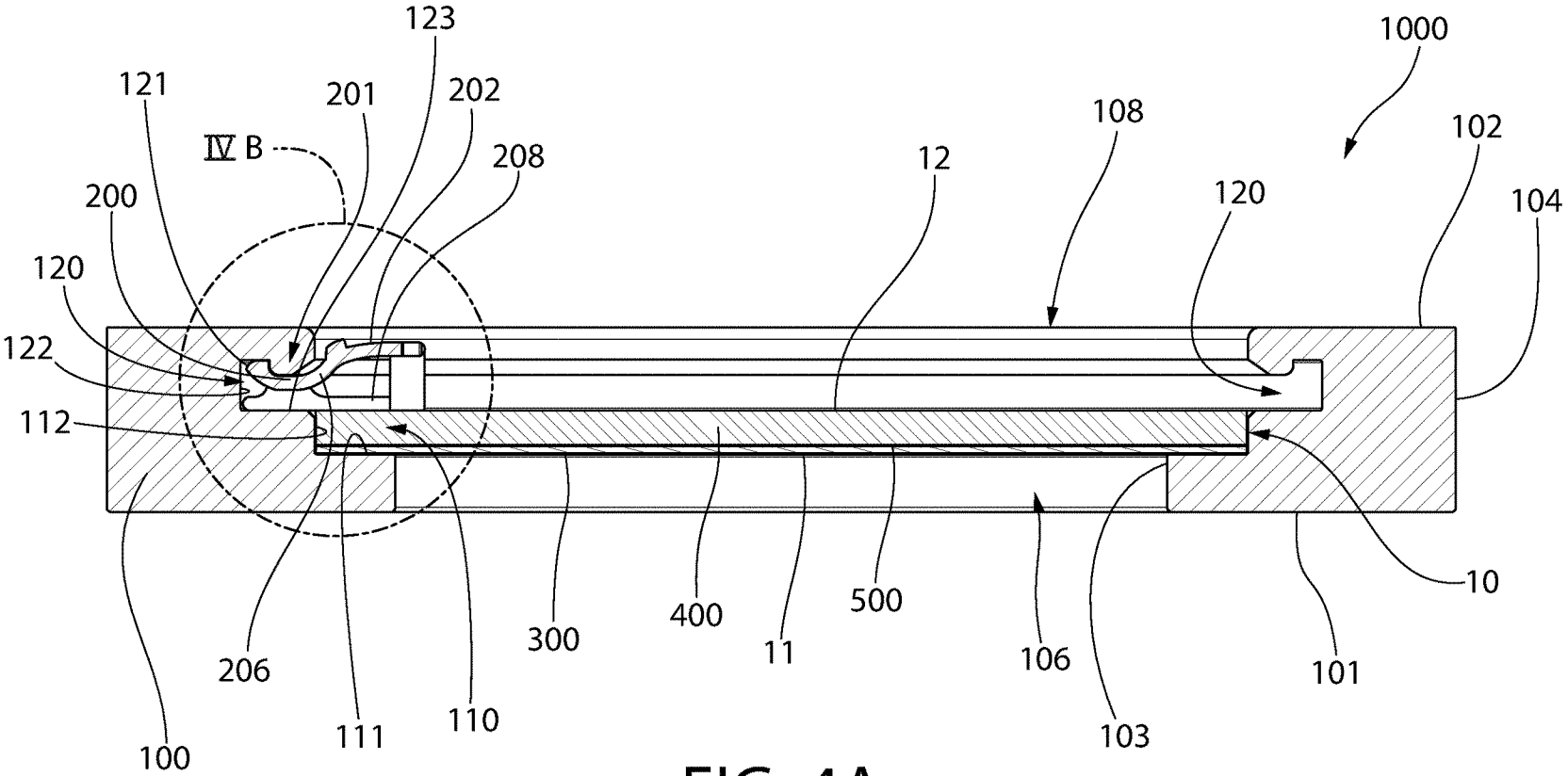
FIG. 4A is a cross-sectional view taken along line IVA-IVA of FIG. 1A.
Figure 4B:
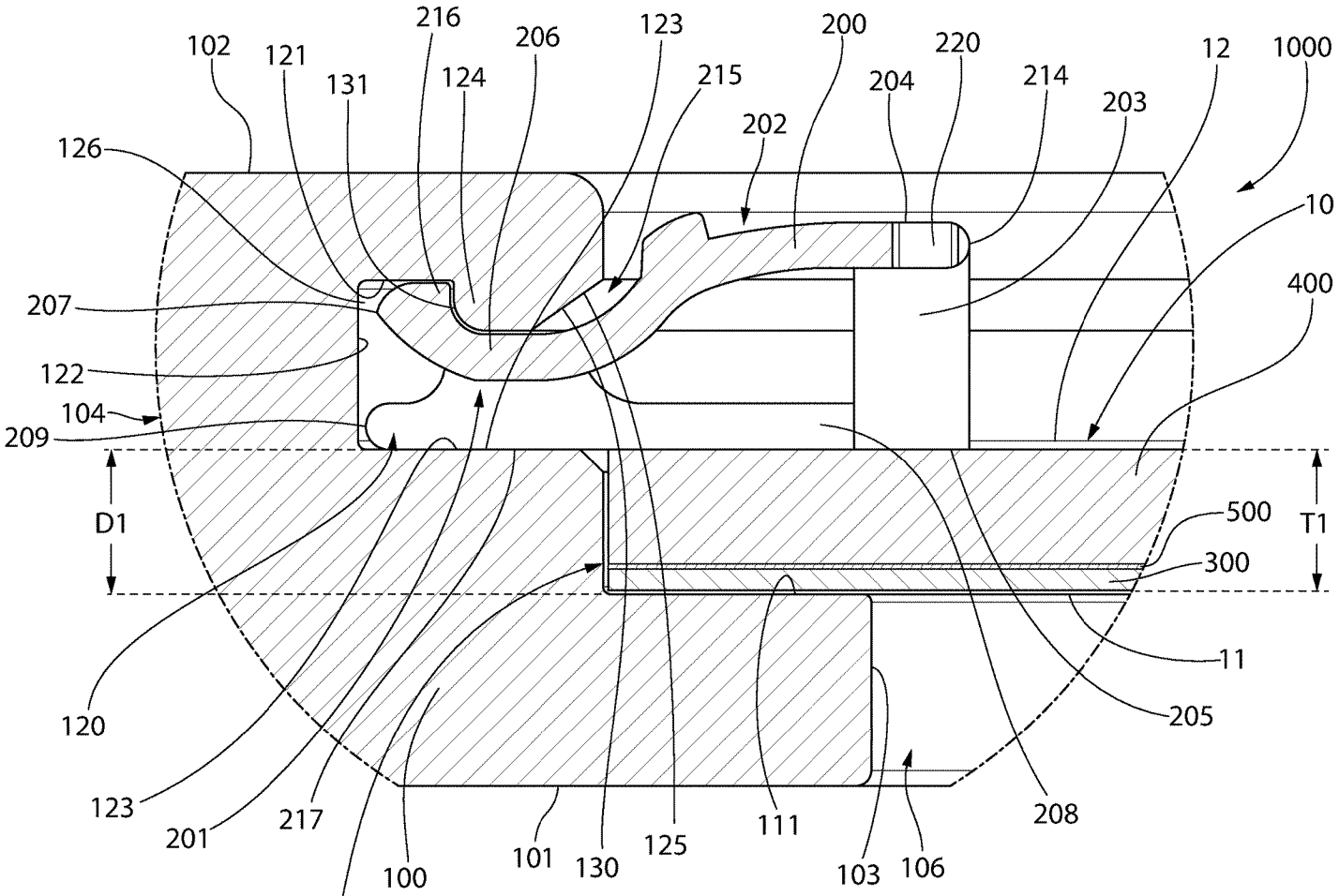
FIG. 4B is a close-up view of area IVB of FIG. 4A.

Referring to FIGS. 3C and 3D, the pivoting of the first leg 206 relative to the base portion 203 of the clip member 200 will be described. FIG. 3C illustrates the clip member 200 in its biased, non-flexed state. Specifically, when no forces are acting upon the first leg 206 relative to the base portion 203, the clip member 200 appears as illustrated in FIG. 3C. FIG. 3D illustrates the clip member 200 in a flexed state due to a downward force F being applied onto the distal portion 216 of the first leg 206 of the clip member 200. The downward force F causes the first leg 206 to pivot relative to the base portion 203 of the clip member 200 about the axis E-E. Due to the force F acting on the first leg 206, the first leg 206 pivots downwardly towards the second leg 207 and towards the bottom end 205 of the base portion 203 of the clip member 200. The first leg 206 of the clip member 200 is pivotable about the axis E-E to permit insertion of the first portion 201 of the clip member 200 into the channel 120 of the frame 100 as discussed below. The engagement between the first portion 201 of the clip member 200 and the channel 120 of the frame 100 may be a cantilever snap-fit in some embodiments.

As will be described in more detail below with reference to FIGS. 6A-6E, the first portion 201 or the first leg 206 of the clip member 200 is automatically transitioned from the non-flexed state into the flexed state during insertion of the first portion 201 of the clip member 200 into the channel 120 of the frame 100 due to the protrusion providing a downward force onto the first leg 206 of the clip member 200. The first portion 201 of the clip member 200 is then automatically transitioned back into the non-flexed state once the first portion 201 of the clip member 200 is fully inserted into the channel 120 of the frame 100 due to cessation of a force applied to the first leg 206 of the clip member 200.

As noted above, the first leg 206 of the clip member 200 comprises a depression 215 having a concave floor that is configured to mate with the protrusion 124 of the channel 120 to securely mount, in a snap-fit manner, the clip member 200 to the frame 100. The first leg 206 of the clip member 200 also comprises the distal portion 216, which forms a hook-like member that engages the trailing edge 131 of the protrusion 124 of the channel 120 to prevent the clip member 200 from being detached from the frame 100 until such time as detachment is desired. However, this is only one exemplified embodiment and other mateable profiles for the first portion 201 of the clip member 200 and the channel 120 of the frame 100 are possible. For example, the first portion 201 of die dip member 200 may have a protuberance that mates with a recess/depression of the channel 120 to facilitate the coupling between the clip member 200 and the frame 100. Other configurations, structures, and features may be incorporated to achieve the coupling of the clip member 200 to the frame 100 while permitting sliding movement of the clip member 200 relative to the frame 100 as discussed below.

In the exemplified embodiment, the first leg 206 of the clip member 200 also comprises a grip protrusion 230 extending therefrom. The grip protrusion 230 provides a surface for a user to grip when inserting the clip member 200 into the channel 120 of the frame 100 and removing the clip member 200 from the channel 120 of the frame 100. The grip protrusion 230 may also assist a user in flexing the first leg 206 to facilitate removal of the clip member 200 from the channel 120 of the frame 100, Referring now to FIGS. 4A and 4B concurrently, the fully assembled frame apparatus 1000 is illustrated in cross-section and close-up, respectively. The stack 10 comprising the glazing 300, the article 500, and the hacker panel 400 are positioned within the rabbet 110. The clip member 200 is mounted to the frame 100 with the first portion 201 of the clip member 200, which comprises portions of the first and second legs 206, 208, disposed within the channel 120 of the frame 100, and with the second portion 202 of the clip member 200 protruding from or located external to the channel 120. As can be seen, it is the distal portions of the first and second legs 206, 208 that include the free, unattached distal ends 207, 209 thereof that are inserted into the channel 120 when coupling the clip member 200 to the frame 100.

When the clip member 200 is coupled to the frame 100 as illustrated, the bottom portion 205 of the base portion 203 of the clip member 200 and a bottom surface 217 of the second leg 208 (and also a bottom surface of the third leg 210, although not illustrated) is in contact with the rear surface 12 of the stack 10 (i.e., the rear surface of the backer panel 400 in the exemplified embodiment). This contact between the clip member 200 and the backer panel 400 for any other rear-most positioned element of the stack that is disposed on the rabbet 110) secures the stack 10 within the rabbet 110. Specifically, the stack 10 is trapped/sandwiched between the clip member 200 and the floor 111 of the rabbet 110, thereby preventing the stack or portions thereof from being removed from the rabbet 110 while the clip member 200 is coupled to the frame 100. As discussed below, in order to insert layers of the stack into the rabbet 110 or remove layers of the stack from the rabbet 110, the clip member(s) 200 must first be detached from the frame 100. Thus, the clip member 200 takes the place of standard turn buttons, flex tabs, and glazier points and renders their use unnecessary.

In certain embodiments, the clip member 200 applies a compression force onto the stack 10 to tightly secure the stack 10 within the rabbit 110. Specifically, in certain embodiments the stack 10 is compressed between the second portion 202 of the clip member 200 and the floor 111 of the rabbet 110. Such compression may be desirable to ensure that the article 500 is not able to slide or move in the fully assembled frame apparatus 1000. In some embodiments, a portion of the rabbet 110 defined between the floor 111 of the rabbet 110 and the bottom surface 123 of the channel 120 has a depth D1 and the stack 10 has a thickness T1. In some embodiments, the thickness T1 of the stack 10 may be equal to or greater than the depth D1 of the portion of the rabbet 110. This will ensure that the clip member 200 compresses the stack 10 in the full assembled frame apparatus 1000, thereby substantially preventing movement of the article 500.

As noted above, the clip member 200 is coupled to the frame 100 via interaction between the protrusion 124 of the channel 120 and the depression 215 and distal portion 216 of the first leg 206 of the clip member 200. As noted above, the leading edge 130 of the protrusion 124 comprises the chamfer 125 that interacts with the distal end 207 of the first leg 206 of the clip member 200 to deflect the first leg 206 from the non-flexed state to the flexed state during coupling of the clip member 200 to the frame 100. Once the distal portion 216 of the first leg 206 passes beyond the protrusion 124, the protrusion 124 nests with the depression 215 of the first leg 206 of the clip member 200 to securely couple the clip member 200 to the frame 100 within the channel 120. Furthermore, the distal portion 216 of the first leg 206 of the clip member 200 engages or abuts against the trailing edge 131 of the protrusion 124 when the first portion 201 of the clip member 200 is positioned within the channel 120 to prevent the clip member 200 from being detached from the frame 100 accidentally. Rather, a user must apply a force onto the dip member 200 (as described above with reference to FIGS. 3C and 3D) to transition it from its natural non-flexed state to its flexed state in order to facilitate removal of the first portion 201 of the clip member 200 from the channel 120 and detachment of the clip member 200 from the frame 100.

Although the clip member 200 is prevented from being readily separated from the frame 100 once it is coupled thereto without user involvement, the clip member 200 is, configured to be slidable relative to the frame 100 within the channel 120 while remaining coupled or mounted to the frame 100. Thus, depending on which inner edge portion 115-118 of the frame 100 (or the frame components 100*a-d*) the clip member 200 is mounted to, the clip member 200 is slidable within the channel 120 along one of the axes A-A, B-B, C-C, D-D without detaching the clip member 200 from the frame 100.

Specifically, the clip member 200 is capable of sliding within the channel 120 along the axis A-A, B-B, C-C, D-D of the linear section of the channel 120 within which the first portion 201 of the clip member 200 is located while the protrusion 124 remains located within, the depression 215 of the, first leg 206. However, due to the biased nature of the clip member 200 being such that the first leg 206 wants to pull upwardly away from the second and third legs 208, 210, the clip member 200 does not slide freely within the channel 120, but rather some force needs to be applied to the clip member 200 relative to the frame 100 to initiate movement of the clip member 200. Specifically, friction between the first leg 206 of the clip member 200 and the top surface 121 of the channel 120 and between the second and third legs 208. 210 of the clip member 200 and the bottom surfaces 123 of the channel 120 prevents the clip member 200 from freely sliding, within the channel 120 without user intervention. Thus, once hung the frame 100 will not slide incidentally along the wall from which it is hung, but it will slide along the wall from which it is hung in response to user action. This will be described in more detail below with reference to FIGS. 7A-8B.

Figure 5A:
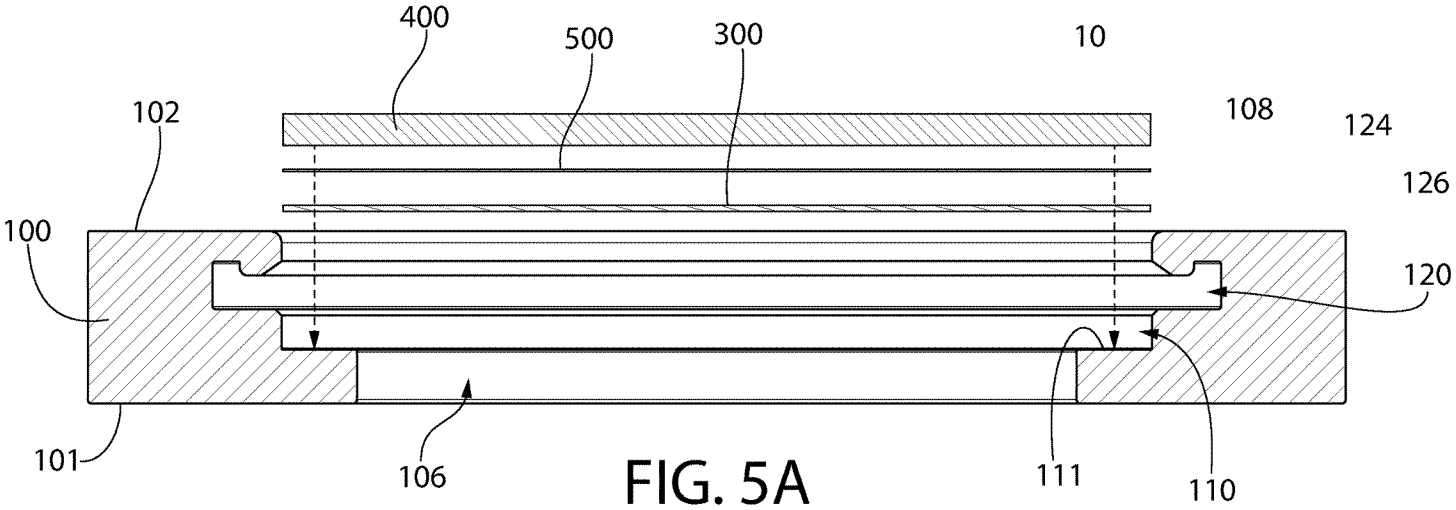
FIGS. 5A and 5B are schematic cross-sectional views of the frame apparatus of FIG. 1A illustrating the process of inserting a stack into a rabbet of the frame.

Referring to FIGS. 5A-6E, assembly of the frame apparatus 1000 will be described. Referring first to FIG. 5A, the frame 100 is illustrated with the stack 10 comprising the glazing 300, the article 400, and the backer panel 500 separate from the frame 100 but prepared for insertion into the rabbet 110 of the frame 100 via the rear opening 108. Specifically, the glazing 300, the article 400, and the backer panel 500 are positioned adjacent the rear surface 102 of the frame 100 in preparation for rear mounting of the glazing 300, the article 400, and the backer panel 500 into the frame 100, FIG. 5B illustrates the stack 10 within the frame 100. Specifically, the stack 10 is inserted through the rear opening 108 of the frame 100 and comes to rest atop of the floor 111 of the rabbet 110. The stack 10, or at least the front-most component of the stack, which in the exemplified embodiment is the glazing 300, has a width and length that is configured to ensure that a perimeter portion of the glazing 300 contacts the floor 111 of the rabbet 110 when inserted into the frame 100. This prevents the stack 10 from passing directly through the display opening 106 of the frame 100. The stack 10 is preferably configured to have a combined thickness that is approximately equal to or less than the thickness of the rabbet 110 to ensure that the stack fits properly within the rabbet 110.

After the stack 10 is disposed within the rabbet 110, the clip member 200 is mounted to the frame 100 to secure the stack 10 within the rabbet 110. Specifically, without the clip member 200 coupled to the frame 100, the stack 10 could simply fall out through the rear opening 108 of the frame 100. The clip member 200 is coupled to the frame 100 to prevent the stack 10 front falling out through the rear opening 108 of the frame 100 so long as the clip member 200, and preferably two or more of the clip members 200, remain coupled to the frame 100.

Figure 5B:
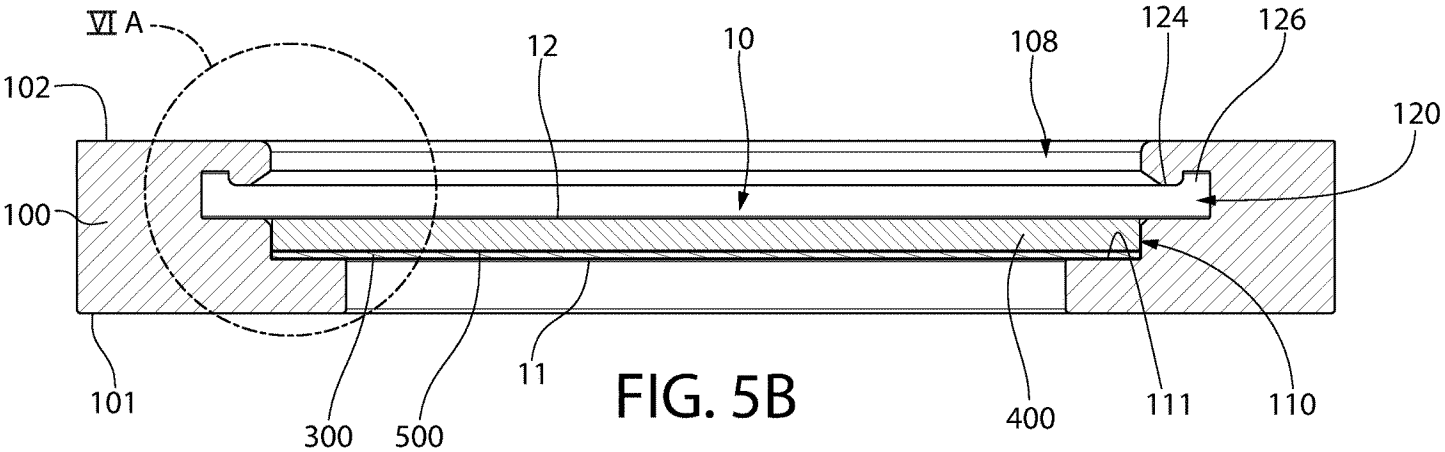
Figure 6A:
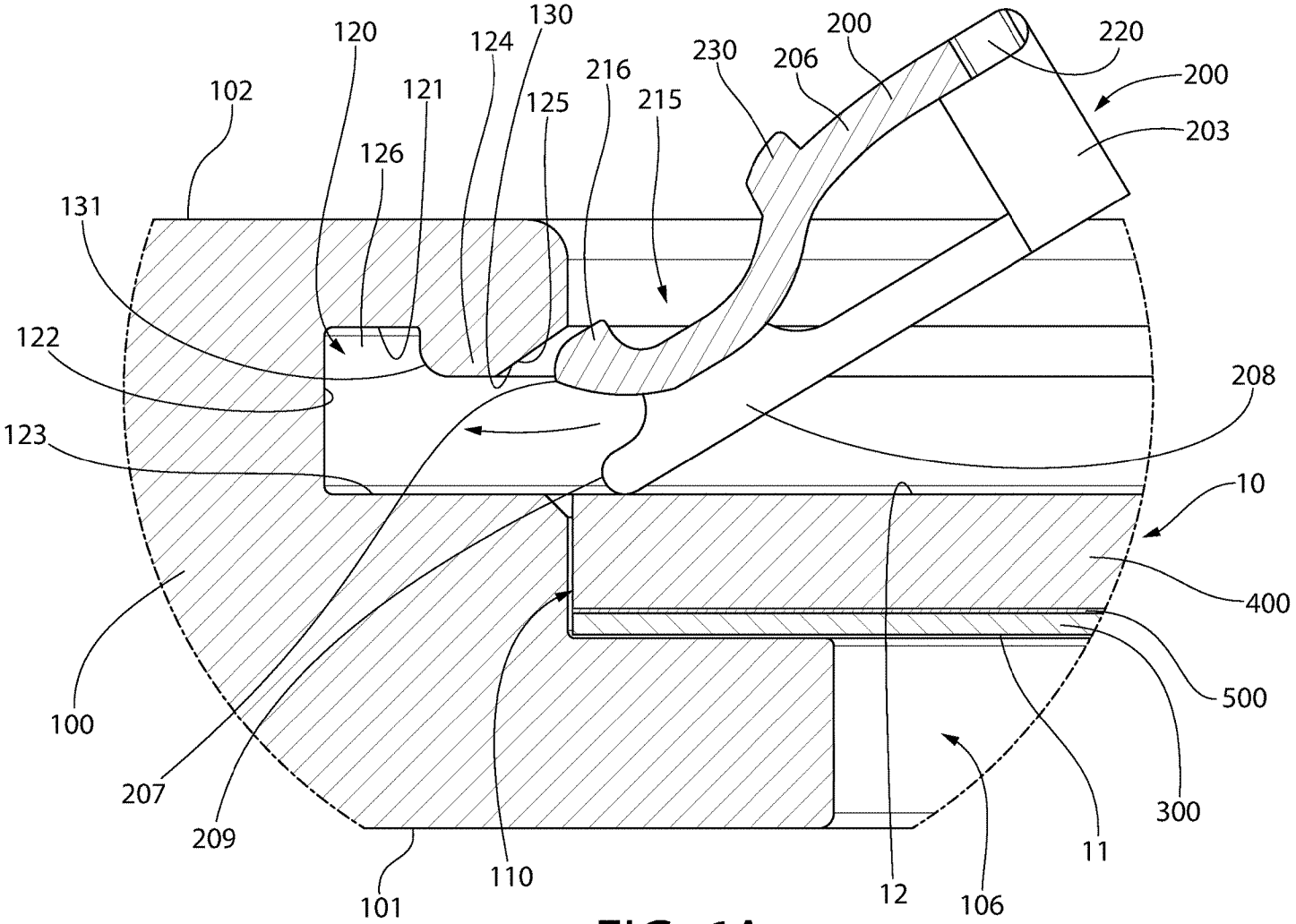
FIGS. 6A-6E are close-up schematic cross-sectional views of area VIA of FIG. 5B illustrating the process of coupling the clip member to the frame.
Figure 6B:
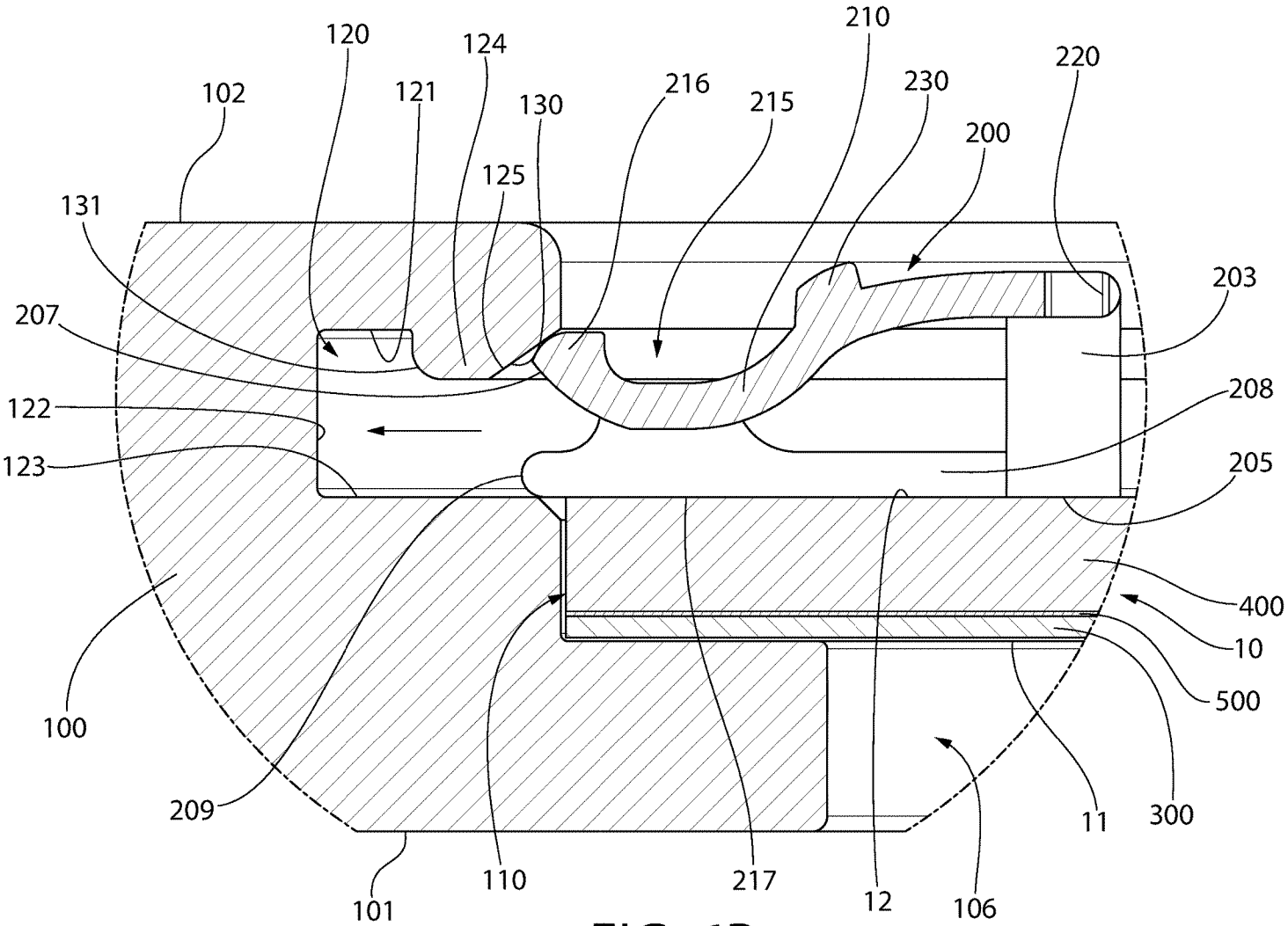

FIGS. 6A-6E are close-up illustrations of area VIA of FIG. 5B that illustrate the process of coupling the clip member 200 to the frame 100 and these figures will be described collectively. First, the clip member 200 is oriented so that the distal ends 207, 209, 211 of the first, second, and third legs 206, 208, 210 of the clip member 200 face the channel 120 of the frame 100 (FIG. 6A). Although the clip member 200 is illustrated being oriented at an angle in FIG. 6A and rotated between FIGS. 6A and 6B, this is not required. The clip member 200 may simply be translated towards the channel 120 without any rotation required as illustrated in FIGS. 6B-6E. The clip member 200 is pressed or otherwise moved towards the channel 120 until the distal portion 216 of the first leg 206 of the clip member 200 contacts the leading, edge 130 of the protrusion 124 (FIG. 6B). Specifically, the clip member 200 is moved towards and into the channel 120 in a direction that is perpendicular to the axis A-A, B-B, C-C, D-D of the channel 120. During this movement of the clip member 200 the bottom surface 205 of the base portion 203 and the bottom surface 217 of the second (and third) leg 208 of the clip member 200 engage or ride along, the rear surface 12 of the stack 10.

Figure 6C:
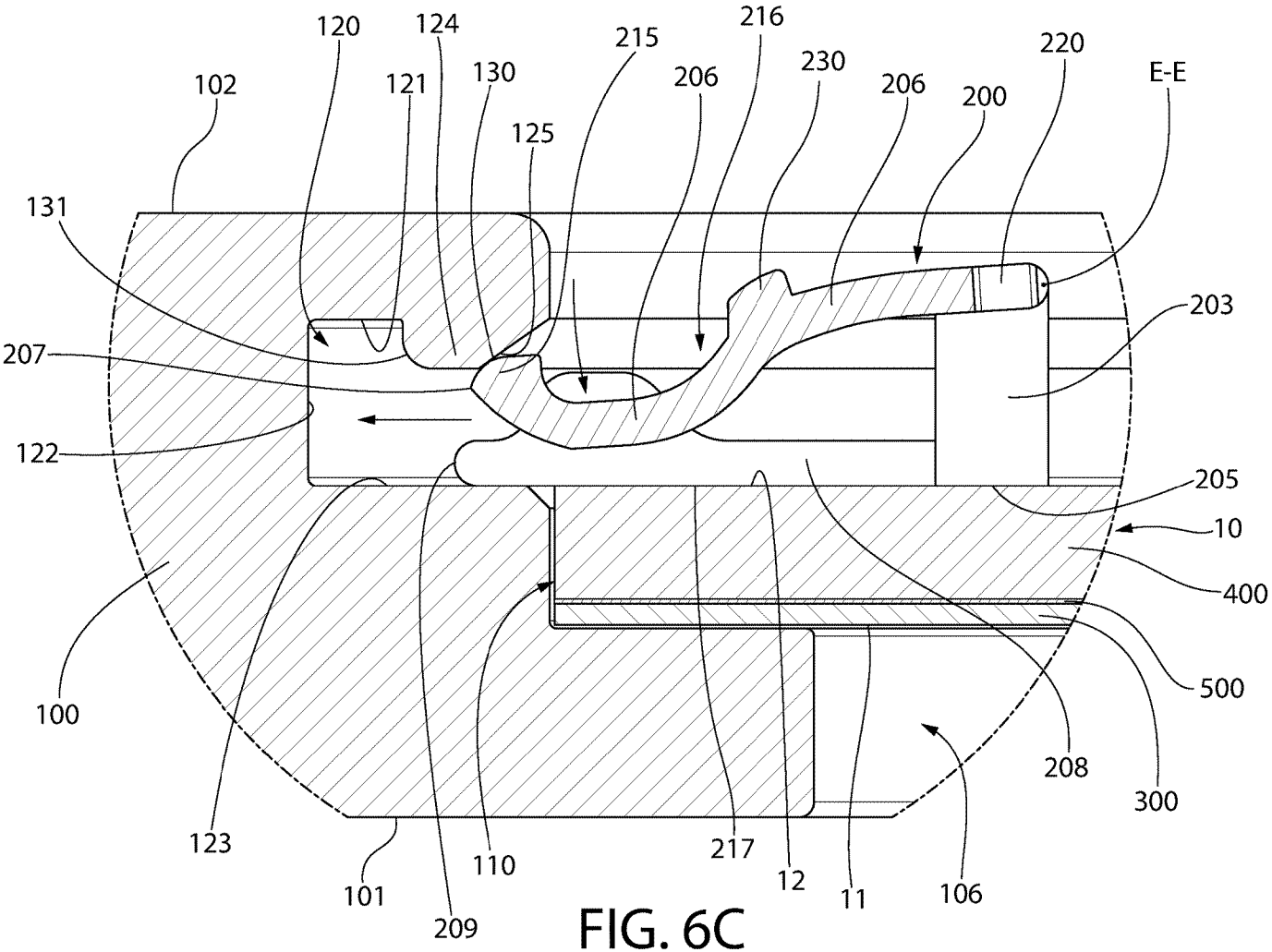

Referring to FIG. 6C, the clip member 200 is continued to be pressed into the channel 120. As the clip member 200 is continued to be pressed into the channel 120, the distal portion 216 of the first leg 206 of the clip member 200 rides along the chamfer 125 of the leading edge 130 of the protrusion 124 while the bottom surface 217 of the second (and third) leg 208 of the clip member 200 rides along the bottom surface 123 of the channel 120 and the rear surface 12 of the stack 10. Due to the downward slant of the chamfer 125, the engagement between the distal portion 216 of the first leg 206 of the clip member 200 and the leading edge 130 of the protrusion 124 causes the first leg 206 of the clip member 200 to pivot downwardly about the axis E-E and transition from the non-flexed (or biased) state into the flexed state.

Figure 6D:
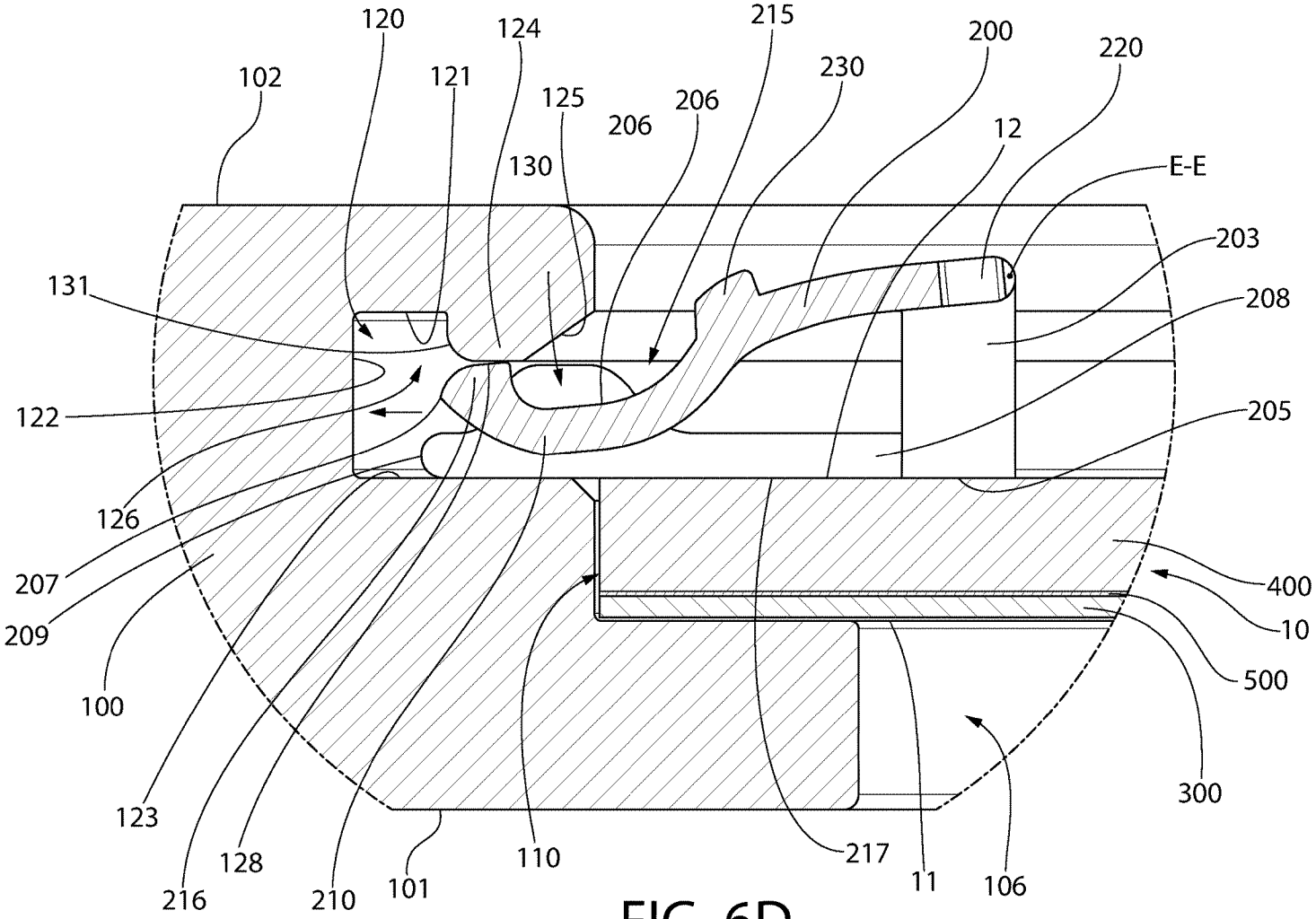
Figure 6E:
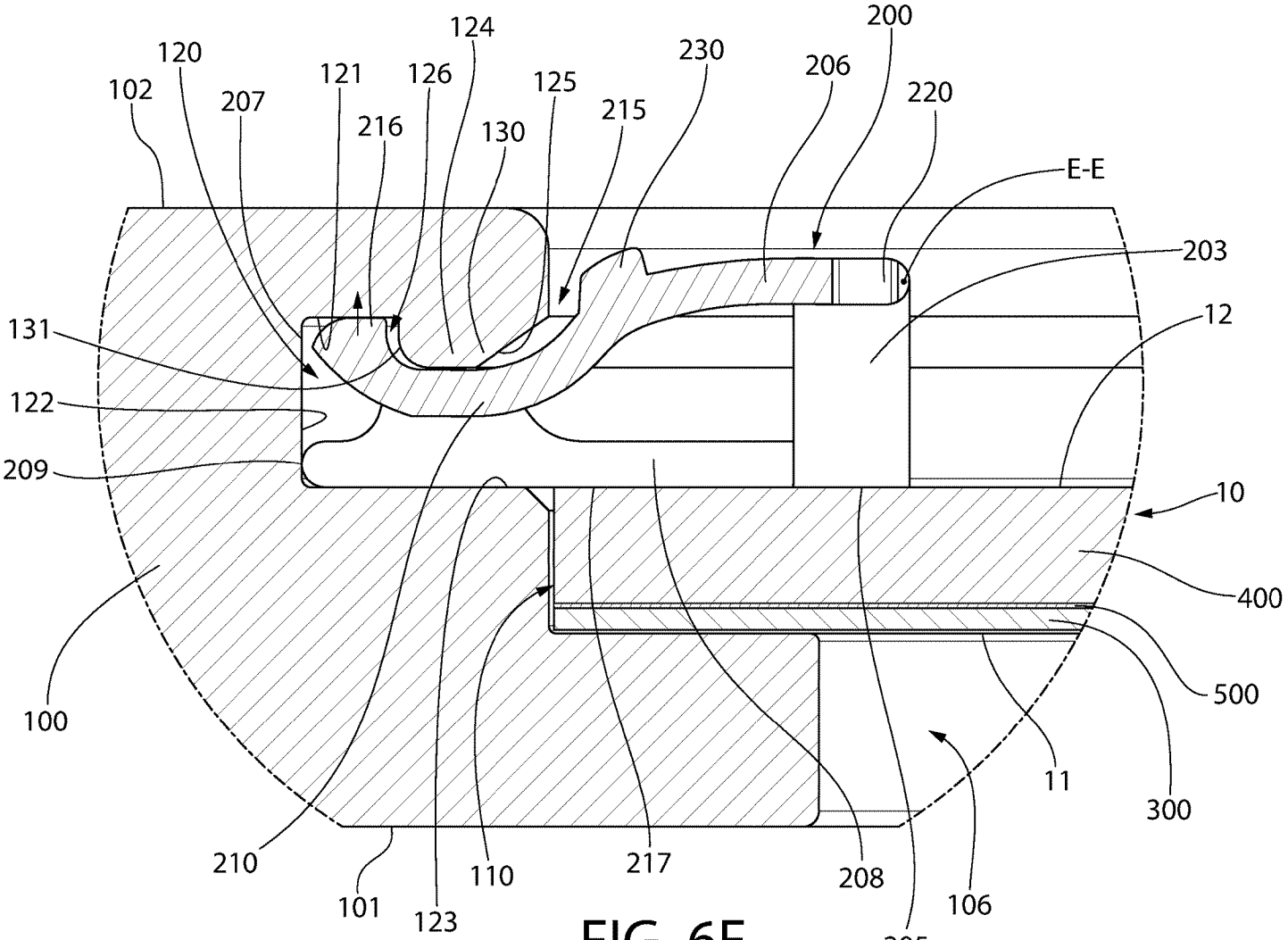

Referring to FIG. 6D, as the distal portion 216 of the first leg 206 of the clip member 200 passes by the leading edge 130 of the protrusion 124, the distal portion 216 of the first leg 206 of the clip member 200 continues to ride along a lower surface 128 of the protrusion 124 until the distal portion 216 of the first leg 206 of the clip member 200 passes beyond the protrusion 124 and enters into the gap 126 formed between the sidewall surface 122 of the channel 120 and the trailing edge 131 of the protrusion 124 (FIG. 6E). During this time, the bottom surface 217 of the second (and third) leg 208 continues to ride along and in contact with the bottom surface 123 of the channel 120 and the rear surface 12 of the stack 10. Once the distal portion 216 of the first leg 206 of the clip member 200 passes the trailing edge 131 of the protrusion 124, the first leg 206 of the clip member 200 will pivot upwardly about the axis E-E back to its biased non-flexed state. Specifically, because the protrusion 124 is no longer applying a downward force onto the first leg 206, the first leg 206 will automatically pivot back into its natural unflexed state.

As shown in FIG. 6E, when the clip member 200 is fully coupled to the frame 100 within the channel 120, the distal portion 216 of the first leg 206 is located within the gap 126 between the trailing edge 131 of the protrusion 124 and the sidewall surface 120 of the channel 120 and the protrusion 124 nests within the depression 215 of the first leg 206. Furthermore, the bottom surface 217 of the second (and third) leg 208 is in contact with the bottom surface 123 of the channel 120 and the rear surface 12 of the stack 10. An attempt to pull, the clip member 200 out of the channel 120 will result in the distal portion 216 of the first leg 206 abutting against the trailing edge 131 of the protrusion 124. Thus, in order to remove the clip member 200 from the channel 120, the first leg 206 must first be flexed downwardly about the axis E-E until the distal portion 216 of the first leg 206 is located below the protuberance 124 so that the clip member 200 can be pulled away from the channel 120 without the distal portion 216 of the first leg. 206 contacting the protrusion 124. As mentioned above, with the clip member 200 coupled to the frame 100, the bottom surface 205 of the base portion 203 and the bottom surface 217 of the second leg 208 (and third leg although not illustrated) of the clip member 200 are adjacent to, and preferably in contact with, the rear surface 12 of the stack 10 thereby trapping the stack 10 between the clip member 200 and the floor 111 of the rabbet 110. In this manner, the clip member 200 takes the place of turn buttons, flex tabs, and glazier points that are typically used to retain the stack 10 within the rabbet 110.

Figure 7B:
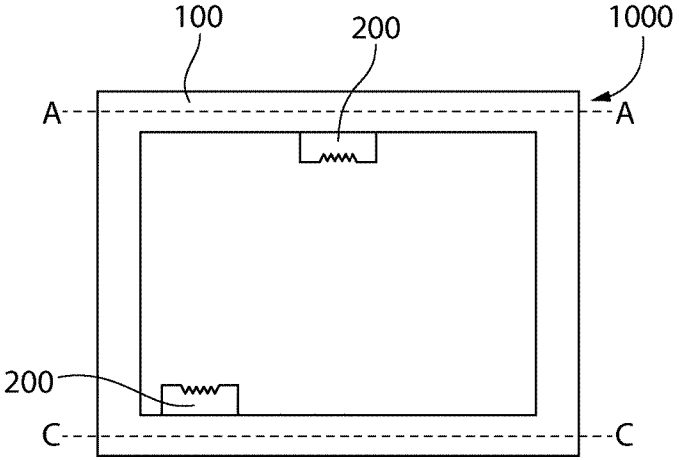
FIGS. 7A-7C are schematic rear views of the frame apparatus of FIG. 1A illustrating the slidability of the clip members relative to the frame when the clip members are coupled to the frame.
Figure 7A:
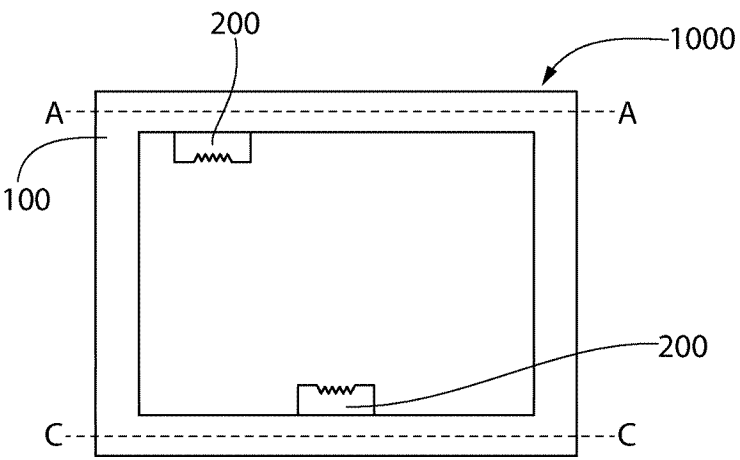
Figure 7C:
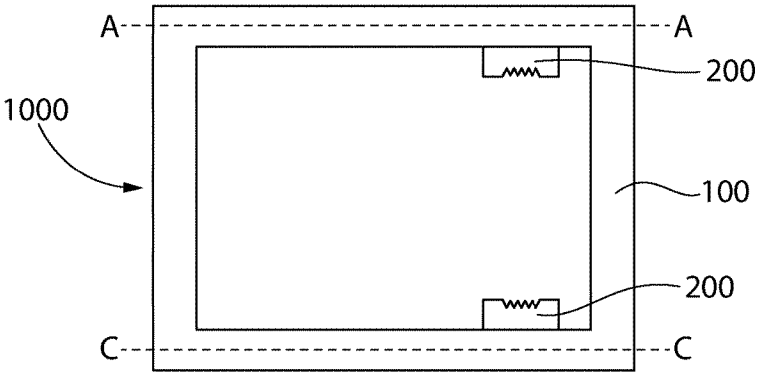

Referring to FIGS. 7A-7C, the slidability of the Clip member 200 when the clip member 200 is coupled to the frame 100 will be described. As noted above, the clip member 200 can slide relative to the frame 100 within the channel 120 while remaining coupled to the frame 100. FIGS. 7A-7C schematically illustrates the frame apparatus 1000 with two of the clip members 200 coupled thereto on opposing sides of the channel 120. Specifically, a first one of the clip members 200 is coupled to a first linear section of the channel 120 that extends along the axis A-A and a second one of the clip members 200 is coupled to a second linear section of the channel 120 that extends along the axis C-C. FIGS. 7A-7C are intended to show that the clip members 200 can move from side-to-side relative to the frame 100 along the axis A-A, C-C of the linear section of the channel 120 to which they are coupled while the clip member 200 remains coupled to the frame 100. Stated another way, without disengaging the clip member 200 from the frame 100 and while the first portion 201 of the clip member 200 is located within the channel 120 of the frame 100, the clip member 200 can slide or move relative to the frame 100. Furthermore, the frame apparatus 1000 could include four of the clip members 200 (i.e., one or more coupled to each linear section of the channel 120), all of which are movable/slidable as illustrated described herein. Furthermore, more than one clip member 200 may be coupled to one of the linear sections of the channel 200, as discussed below with reference to FIGS. 9A and 9B.

Figure 8A:
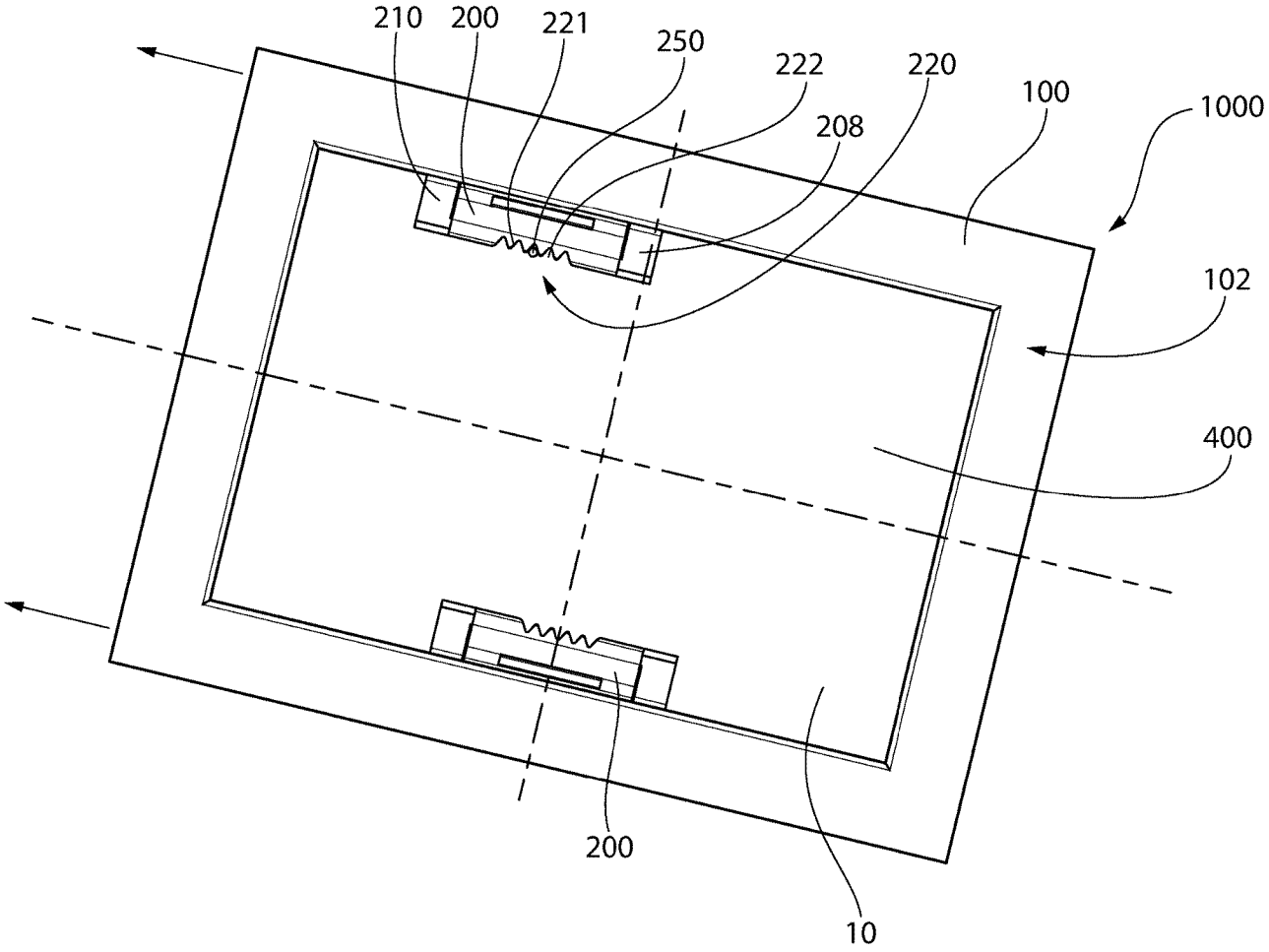
FIGS. 8A and 8H are rear views of the frame apparatus of FIG. 1A illustrating a self-leveling feature in accordance with one embodiment.
Figure 8B:
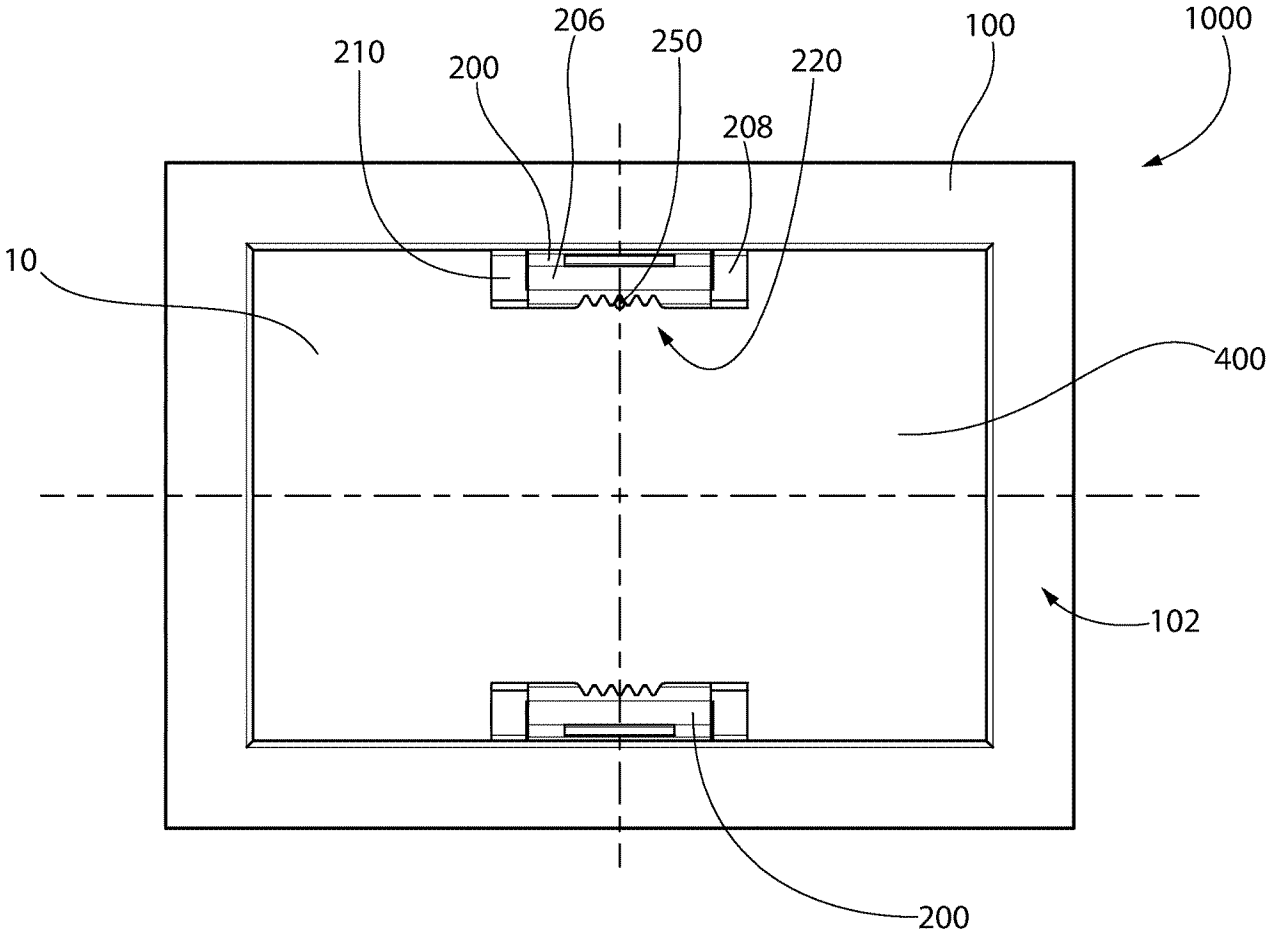

Referring to FIGS. 8A and 8B, the sliding movement of the clip members 200 facilitates ensuring that the frame 100 is hung in a level manner. Ensuring a level hang from a wall is an important consideration in frame hanging. There are many devices in existence which are intended to assist a user in ensuring that frames hung from a wall are level. However, the clip members 200 are an advancement in that the same component that is used to secure the article within the frame 100 is also used to easily ensure that the frame 100 is hung in a level manner.

FIG. 8A illustrates the frame 100 hung from a wall as seen through the wall (the wall is not illustrated in the drawings to enable the frame 100 to be seen). A banging element 250 is illustrated protruding from the wall. The hanging element 250 may be a screw, a nail, or any other component commonly used to hang frames, particularly frames that use a sawtooth-style hanger, from a wall. The hanging feature 220 of the clip member 200 is made to engage the hanging element 250. More specifically, the hanging element 250 is located within one of the notches 222 between adjacent ones of the teeth 221 of the hanging feature 220 of the clip member 200. At first, the frame 100 is not level in that the two side surfaces of the frame 100 are not perpendicular to the plane of the floor and the top and bottom surfaces are not parallel with the plane of the floor (FIG. 8A). However, with the clip member 200, this can be easily remedied.

Specifically, in order to level the frame 100, a user can grip the frame 100 and move it along the wall to one side or the other while the hanging feature 220 of the clip member 200 remains engaged or coupled to the hanging element 250 protruding from the wall so that the clip member 200 moves relative to the frame 100 (or the frame 100 moves relative to the clip member 200). During this movement of the frame 100, the clip member 200 slides within the channel 120 relative to the frame 100, which assists in leveling the frame 100 as it hangs from the wall. The location of the clip member 200 relative to the wall does not change, but rather the location of the frame 100 relative to the wall changes during this leveling process. As can be seen in FIG. 8B, the clip member 200, and more specifically the hanging element 250, is centered within the frame 100. This centering levels the frame 100 as it is hung from the wall, and this leveling is achieved without removing the frame 100 from the wall.

Figure 9A:
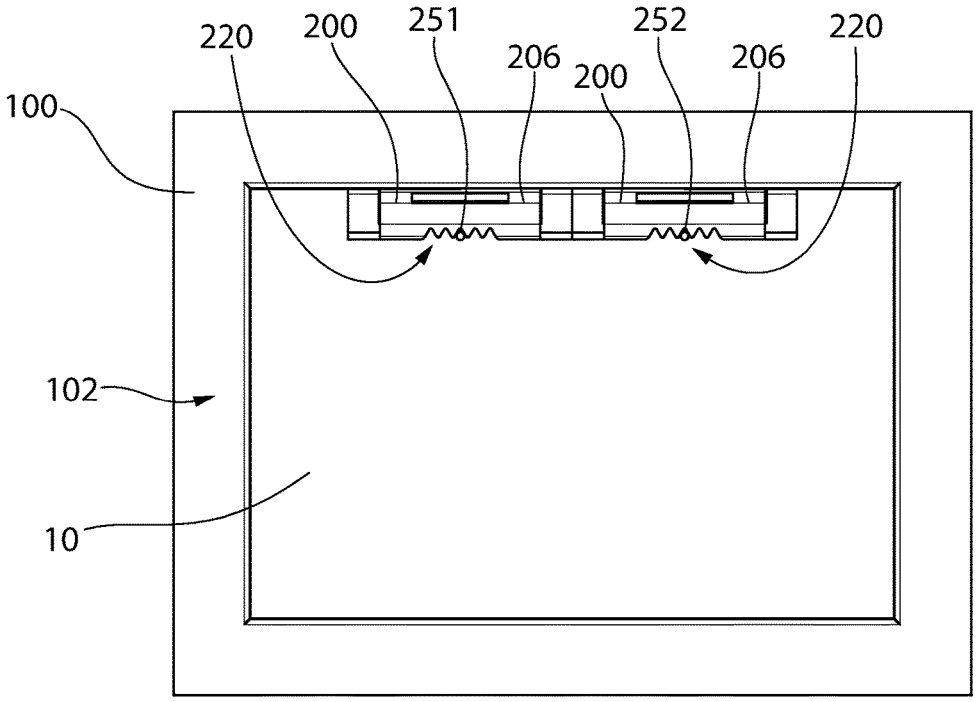
FIGS. 9A and 9B are rear views of the frame apparatus of FIG. 1A illustrating a self-leveling feature in accordance with another embodiment.
Figure 9B:
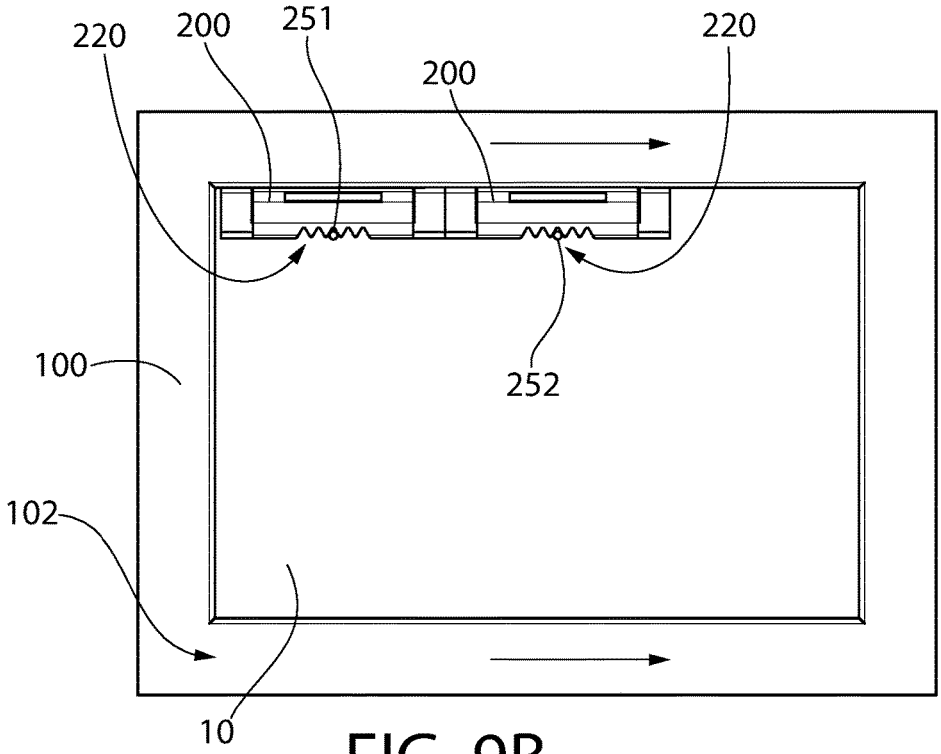

Referring to FIGS. 9A and 9B, the frame apparatus 1000 is illustrated with two of the clip members 200 coupled to the frame 100 within the same linear section of the channel 420. Although the channel 120 is not visible in FIGS. 9A and 9B, the details of its structure and location described above are applicable here. Similar to FIGS. 8A and 8B, FIGS. 9A and 9B is a view of the frame 100 hung from a wall as seen through the wall (the wall is not illustrated in the drawings to enable the frame 100 to be seen). In this embodiment, there are two hanging elements 251, 252 (i.e., screws, nails, or the like) protruding from the wall to which it is desired to hang the frame 100. The hanging feature 220 of each of the clip members 200 is coupled to one of the hanging elements 251, 252.

The benefit of having two of the clip members 200 mourned in one of the linear sections of the channel 200 is as follows. As described in FIGS. 8A and 8B, when only one clip member 200 is used for hanging, the tilt/orientation of the frame 100 on the wall will change as the frame is slid side-to-side along the wall. By using two of the clip members 200 in one of the linear sections of the channel 200, the frame 100 can be slid side-to-side along the wall without changing the orientation at which it is hung from the wall. Specifically, because there are two hanging features 220 (one on each clip member 200), there are two contact points between the hanging elements 251, 252 and the frame apparatus 1000. Thus, as long as the hanging elements 251, 252 are located on the wall in an aligned manner (such that a plane parallel to the floor of the room intersects both of the hanging elements 251, 252), the frame 100 will remain at a level hanging orientation. This is true regardless of the movement of the frame 100 along the wall, which is shown in FIG. 9B compared to FIG. 9A.

Referring to FIG. 10, an alternative embodiment of a frame 600 is illustrated. The frame 400 is identical to the frame 100 except for the frame profile. Specifically, rather than having straight perpendicular sides, the frame 600 has a curved front profile, which may be used depending on the desired aesthetic. Basically, many different frame profiles can be used with the inventive features described herein. Thus, FIG. 10 is intended to portray that different frame profiles may be used with the clip member 200. The frame 600 simply needs to include a channel (such as the channel 120) that is capable of or configured to interact with the first portion 201 of the clip member 200 to facilitate coupling of the dip member 200 to the frame 600. The rabbet 110 and the stack 601 therein may be similar to that which has been described in detail above.

Figure 11:
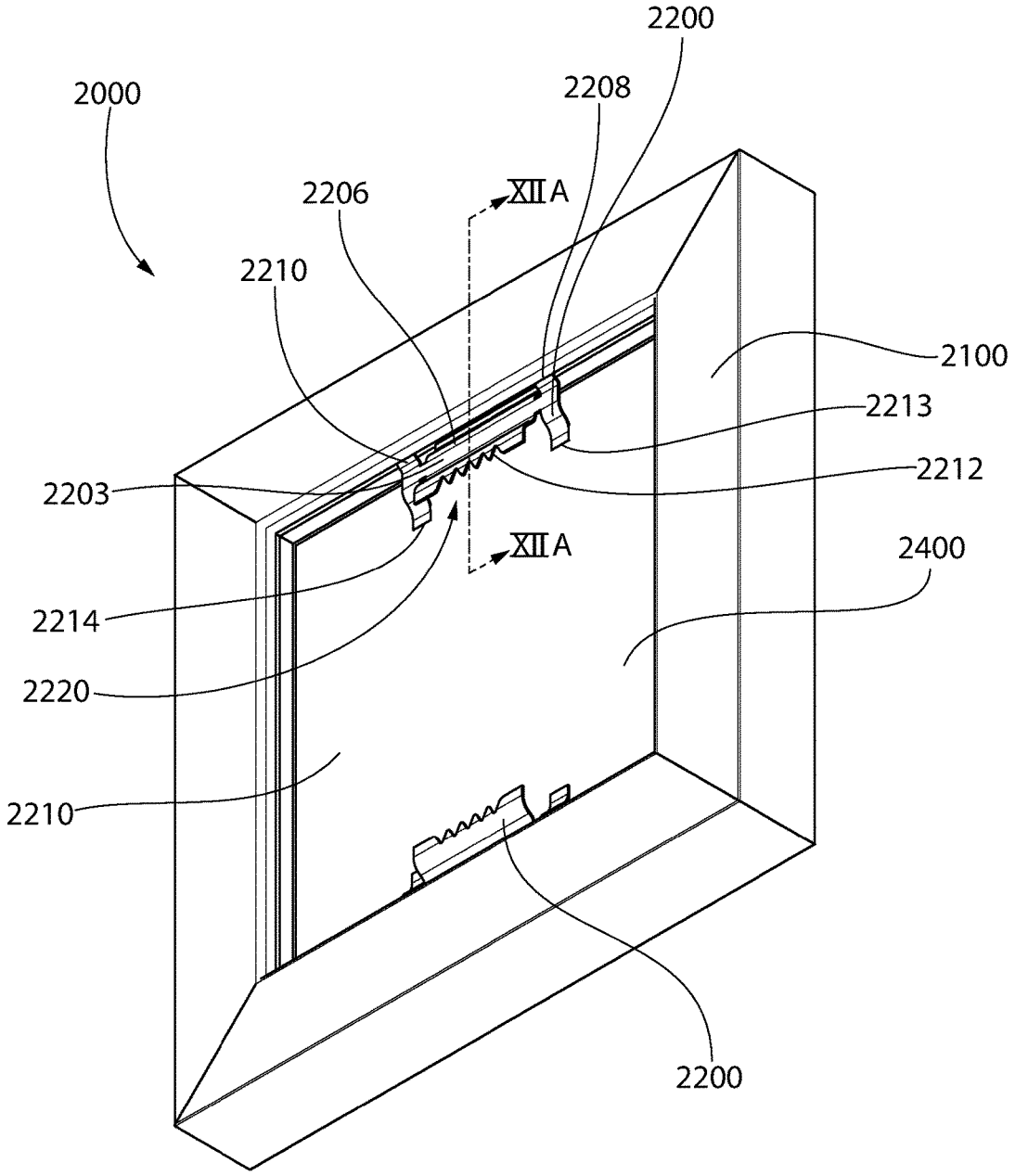
FIG. 11 is a rear perspective view of a frame apparatus having a frame and a clip member coupled thereto in accordance with another embodiment of the present invention.
Figure 11A:
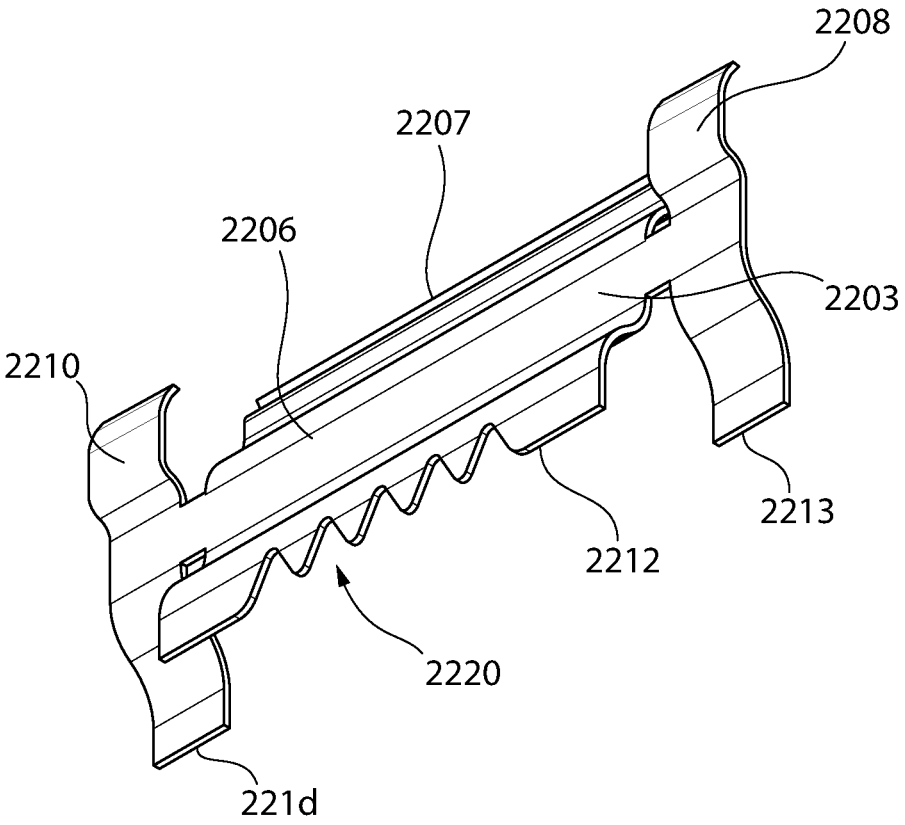
FIG. 11A is a perspective view of the clip member of FIG. 11.
Figure 12A:
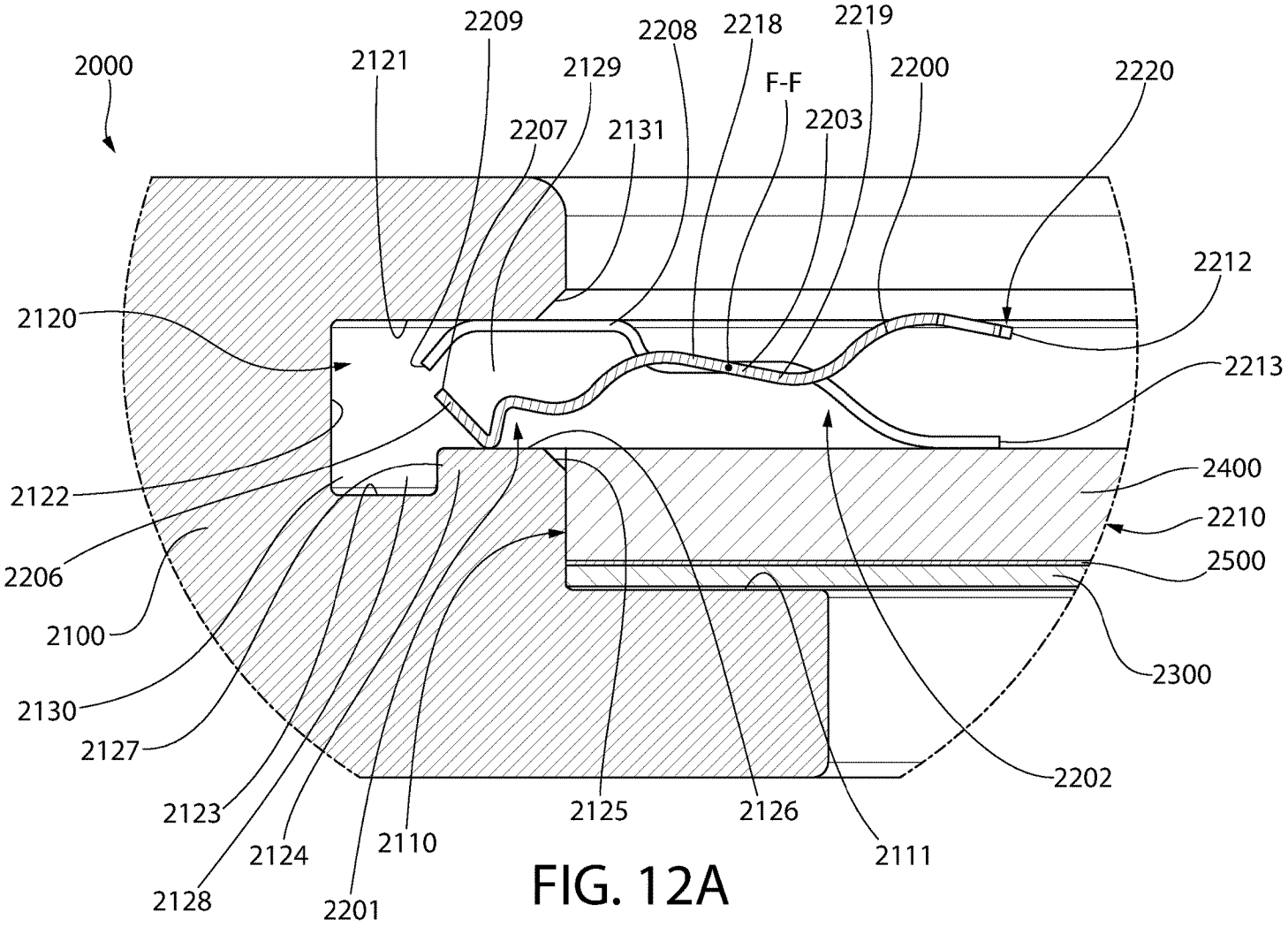
FIGS. 12A and 12B are cross-sectional views taken along line XIIA-XIIA of FIG. 11 illustrating the process of coupling the clip member to the frame.
Figure 12B:
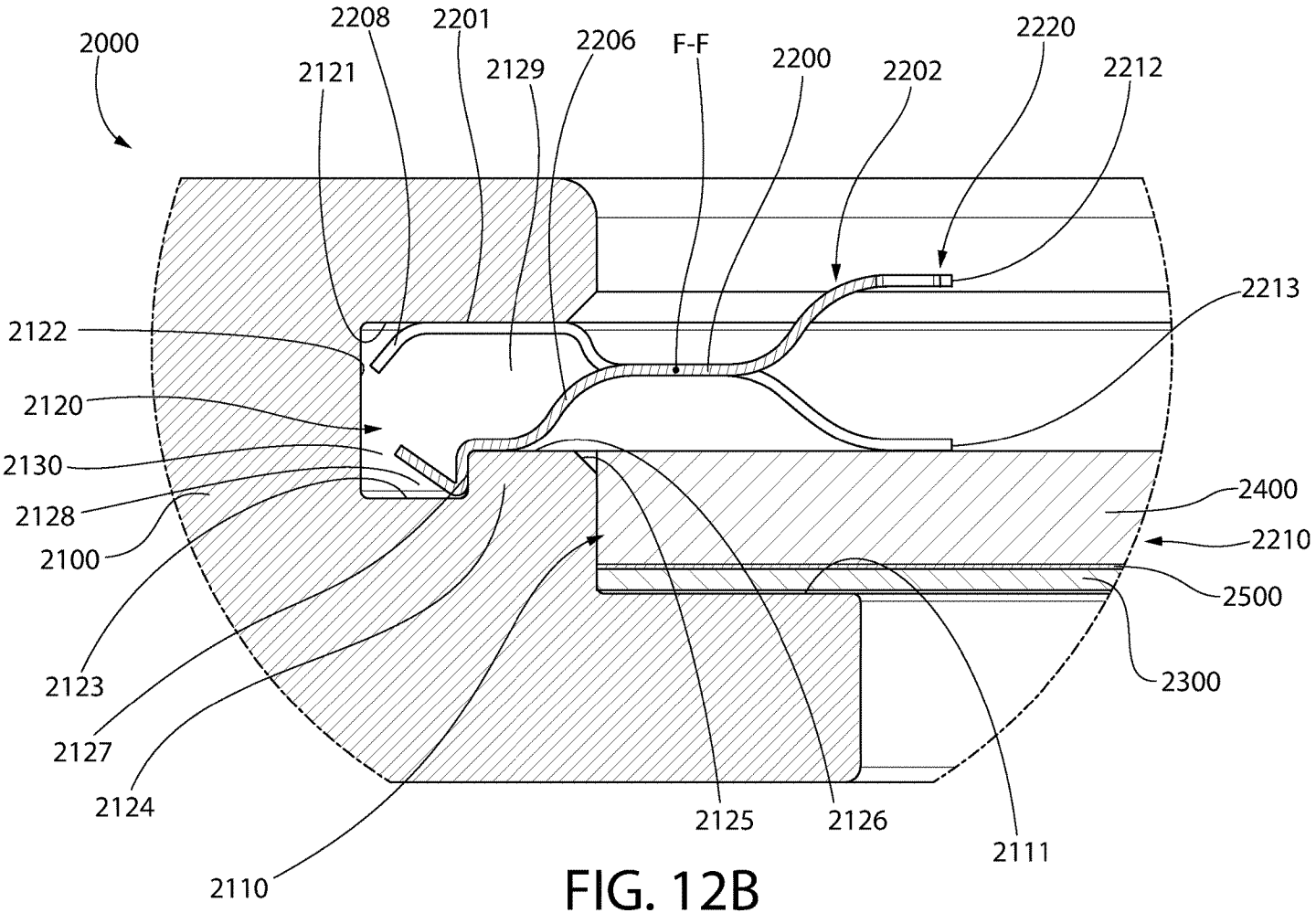

FIGS. 11-12B illustrate an alternative embodiment of a frame apparatus 2000 in accordance with the present invention. Many of the features of the frame apparatus 2000 are similar to the frame apparatus 1000 and such features will not be described herein below, it being understood that the description above applies. Thus, only the new features or different features of the frame apparatus 2000 relative to the frame apparatus 1000 will be described with reference to FIGS. 11-12B.

The frame apparatus 2000 generally comprises a frame 2100, a clip member 2200, and a stack 2210 comprising a glazing 2300, a backer panel 2400, and an article 2500 (although the stack 2210 may omit the glazing 2300 and/or the backer panel 2400 and in other embodiments the stack 2210 may be a mirror or other article). The frame 2100 has a rabbet 2110 defined by a floor 2111 and a sidewall 2112 of the frame 2100. Furthermore, a channel 2120 is formed into the sidewall 2112 of the rabbet 2110. The channel 2120 is defined by a top surface 2121, a sidewall surface 2122, and a bottom surface 2123. In this embodiment, a protrusion 2124 extends from the bottom surface 2123 into the channel 2120 towards the top surface 2121. The protrusion 2124 comprises a leading edge 2125 having a chamfer, a top surface 2126, and a trailing edge 2127. The trailing edge 2127 of the protrusion 2124 is spaced apart from the sidewall surface 2122 of the channel 2120 by a gap 2128. Furthermore, the top surface 2121 also has a chamfered portion 2131 that facilitates insertion of the clip member 2200 into the channel 2120.

The stack is positioned within a rabbet 2110 of the frame 2100 and is secured within the rabbet 2110 by being sandwiched between a floor 2111 of the rabbet 2110 and the clip member 2200 similar to the previously described embodiment. The main differences between the frame apparatus 2000 and the frame apparatus 1000 is the shape/configuration of the channel 2120 and the shape/configuration of the clip member 2200, the details of which will be described below.

In this embodiment the clip member 2200 is a metal clip, although it is not to be limited as such in all embodiments. The clip member 2200 has a first portion 2201 and a second portion 2202. More specifically, the clip member 220 comprises a base portion 2203, a first leg 2206, a second leg 2208, and a third leg 2210. In this embodiment, each of the first, second, and third legs 2206, 2208, 2210 extends from both opposing sides of the base portion 2203. Specifically, within the first portion 2201, the first leg 2206 extends from a first side 2218 of the base portion 2203 to a distal end 2207, the second leg 2208 extends from a first side 2218 of the base portion 2203 to a distal end 2209, and the third leg 2210 extends from a first side 2218 of the base portion 2203 to a distal end 2211. Within the second portion 2202, the first leg 2206 extends from a second side 2219 of the base portion 2203 to a proximal end 2212, the second leg 2208 extends from a second side 2219 of the base portion 2203 to a proximal end 2213 and the third leg 2219 extends from a second side 2219 of the base portion 2203 to a proximal end 2214.

The first portion 2201 of the clip member 2200 is inserted into the channel 2120 to couple the clip member 2200 to the frame 2100 and the second portion 2202 of the clip member 2200 is located outside of the channel 2120 and is used to secure the stack 2210 within the rabbet 2110 and to hang the frame 2100 from a wall. In that regard, in the exemplified embodiment the portion of the first leg 2206 that extends from the second side 2219 of the base portion 2203 comprises a hanging feature 2220. More specifically, the hanging feature 2220 is formed into the proximal end 2212 of the first leg 2206 of the clip member 2200. In the exemplified embodiment, the hanging feature 2220 is a sawtooth hanger as with the previously described embodiment of the clip member 200.

The clip member 2200 is biased into an expanded state as illustrated in FIG. 12B and is configured to be capable of flexing into a flexed state as illustrated in FIG. 12A. Thus, as the clip member 2200 begins to be inserted into the channel 2120, the width of the channel 2120 at an entryway section 2129 of the channel 2120 (where the protrusion 2124 is located) causes the clip member 2200 to flex and shrink in height by pivoting about an axis F-F. Specifically, as the clip member 2200 is translated into the channel 2120, the first leg 2206 rides alone the stack 2210 and the top surface 2126 of the protrusion 2124 and the distal end 2209 of the second leg 2208 (and also the distal end 2211 of the third leg 2210 although not shown in the drawings) engage the chamfer 2.131 of the top surface 2121 of the channel 2120. The chamber 2131 causes the clip member 2200 to flex such that the second and third legs 2208, 2210 pivot about the axis F-F downwardly towards the first leg 2206. The clip member 2200 continues to be translated into the channel 2120 with the first leg 2206 riding along the top surface 2126 of the protrusion 2124 and the second and third legs 2208, 2210 abutting against the top surface 2121 of the channel 2120.

As the first portion 2201 of the clip member 2200 passes beyond the protrusion 2124, the first leg 2106 pivots downwardly about the axis F-F and enters into a nesting section 2130 of the channel 2120. This is because the nesting section 2130 has a greater height than the height of the entryway section 2129. Due to the biasing nature of the clip member 2200, as soon as the height of the channel 2120 increases, the clip member 2200 pivots back into its normal biased state by the first leg 2206 pivoting about the axis F-F while the second and third legs 2208, 2210 remain in contact with the top surface 2121 of the channel 2120.

Thus, the functionality and assembly of the frame apparatus 2000 is similar to the frame apparatus 1000 except there are minor differences in the structure of the various components, which will be better understood from reviewing the drawings which form a part hereof The clip member 2200 retains the stack within the rabbet 2110 in much the same way as described above. Specifically, the second and third legs 2208, 2210 within the second portion 2202 of the clip member 2200 compress the stack 2210 within the rabbet 2110. The hanging feature 2220 at the proximal end 2212 of the first leg 2206 is accessible for hanging the frame apparatus 2000 from a hanging element protruding from a wall. Furthermore, the clip member 2200 is configured to slide within the channel 2120 while mounted to the frame 2000 to assist in level hanging of the frame apparatus 2000 in a similar manner to that described above with regard to the frame apparatus 1000.

Figure 13A:
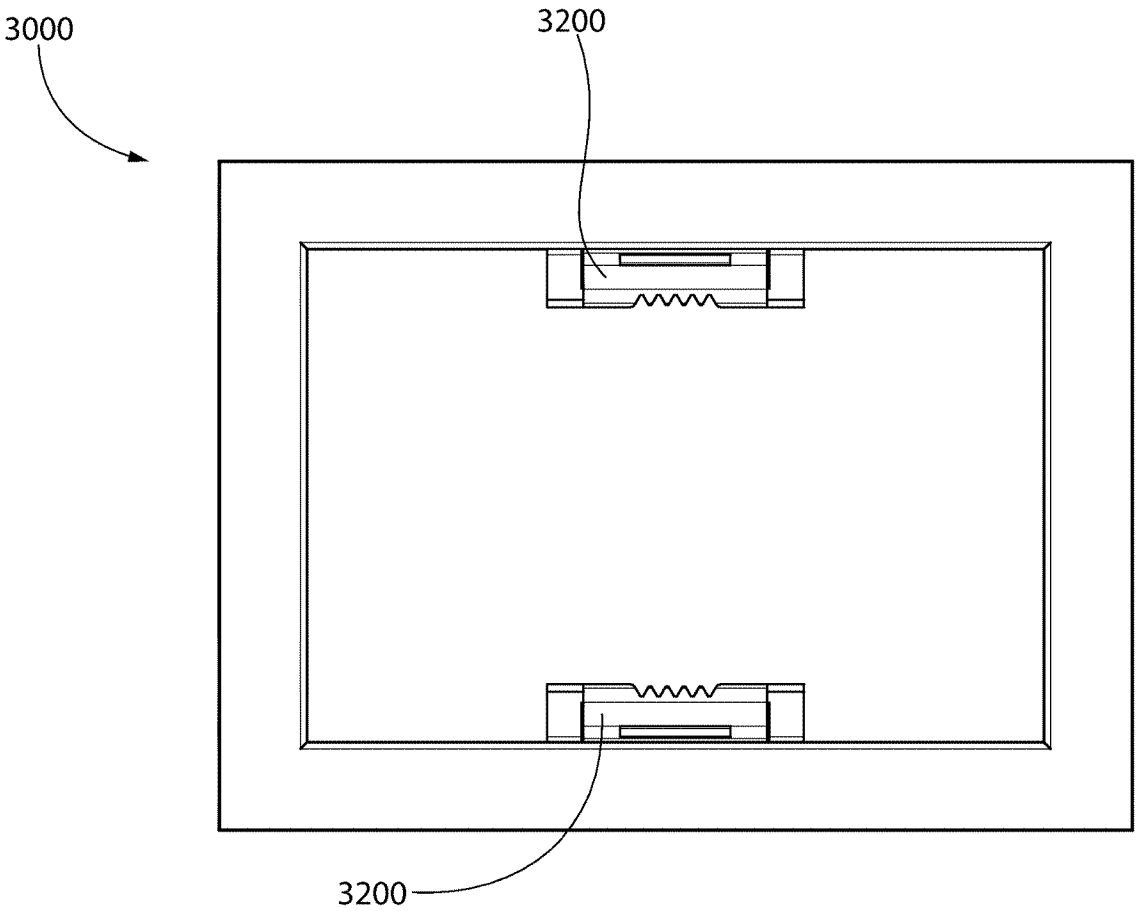
FIG. 13A is a rear view of a frame apparatus illustrating the frame in a landscape orientation.
Figure 13B:
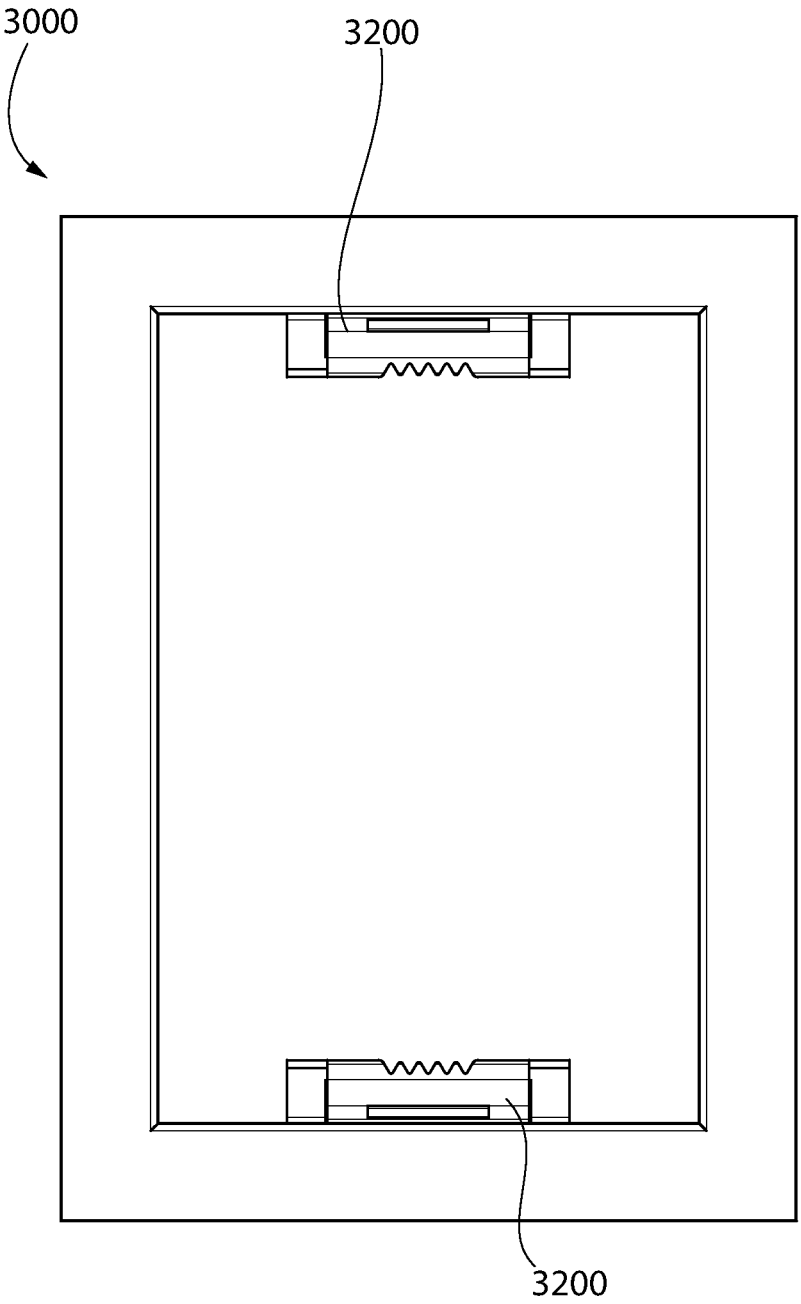
FIG. 13B is a rear view of the frame apparatus of FIG. 13A illustrating the frame in a portrait orientation.

Referring to FIGS. 13A and 13B, a frame apparatus 3000 is illustrated. FIG. 13A illustrates the frame apparatus 3000 in a landscape orientation and FIG. 13B illustrates the same frame apparatus 3000 in a portrait orientation. FIGS. 13A and 13B are intended to show that the clip members 3200 may be moved to different portions or linear sections of the channels as needed. Specifically, when in the landscape orientation of FIG. 13A, the clip members 3200 are on the top and bottom portions of the frame 3100. When in the portrait orientation in FIG. 13B, the clip members 3200 are on the top and bottom portions of the frame 3100 even though these are different portions than in FIG. 13A.

In certain embodiments, it is desirable that two of the clip members 200, 2200, 3200 (the numeral 200 is used for the remainder of this discussion for the clip members, it being understood that the same description applies to all of the clip members) are used in any of the frame assemblies described herein. Furthermore, such clip members 200 should be located on opposite sides of the channel rather than adjacent sides of the channel to ensure that the clip members 200 adequately retain the stack within the rabbet of the frame. The top and bottom are the preferable locations so that the top clip member 200 can also be used to hang the frame apparatus from a wall as described herein.

Figure 13C:
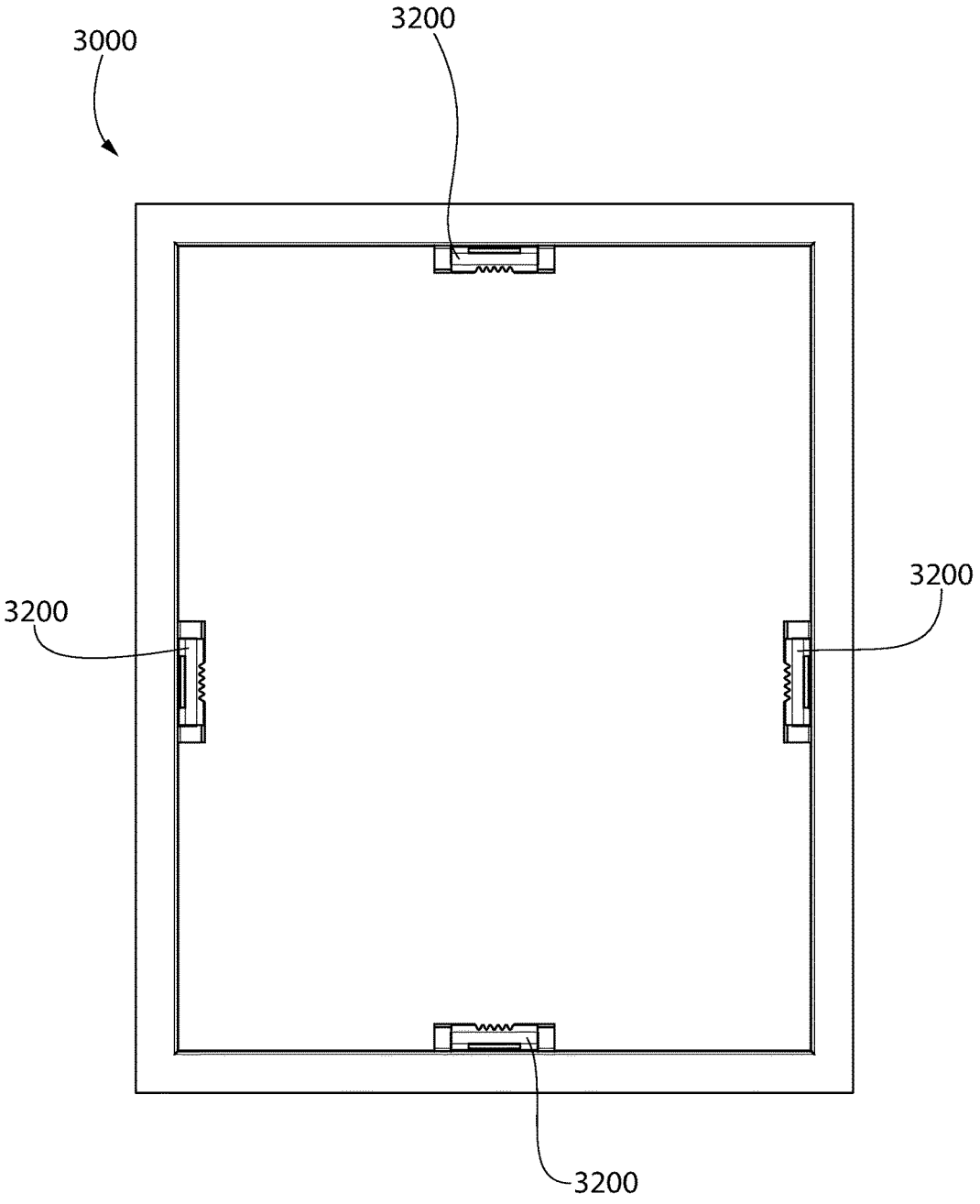
FIG. 13C is a rear view of a frame apparatus illustrating four of the clip members coupled to the frame.

FIG. 13C illustrates an alternative embodiment in which the frame apparatus 3000 includes four of the clip members 3200, one on each of the sides or linear sections of the channel. In other embodiments, for example as discussed above with reference to FIGS. 9A and 9B, more than one of the clip members may be located within one or more of the linear sections of the channel. Although any number of the clip members 3200 may be used, it is preferable that at least two are used. Although the maximum number illustrated is four of the clip members 3200, more than four of the clip members 3200 may be used depending on the dimensions of the frame to which they are coupled or mourned.

Figure 14:
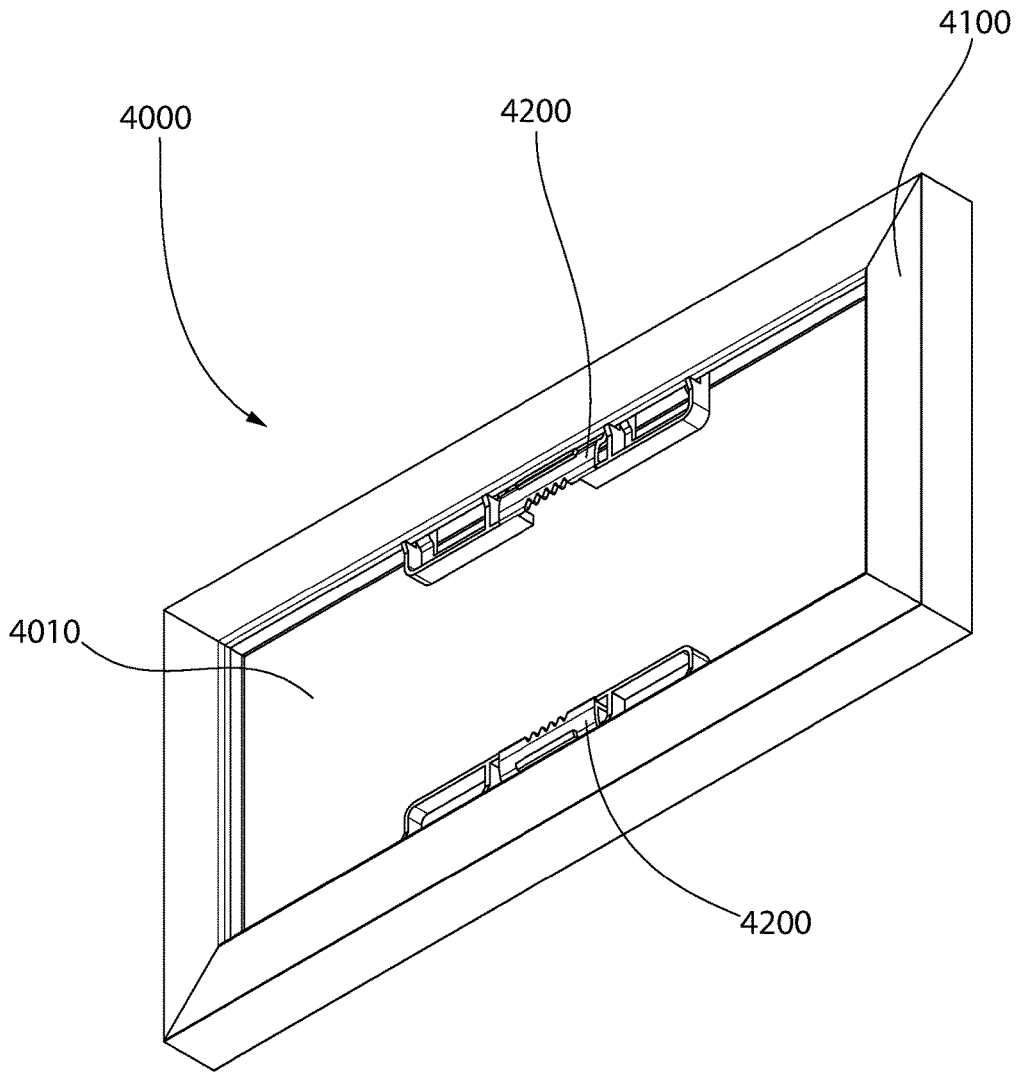
FIG. 14 is a rear perspective view of a frame apparatus having a frame and a clip member coupled thereto in accordance with another embodiment of the present invention.
Figure 15:
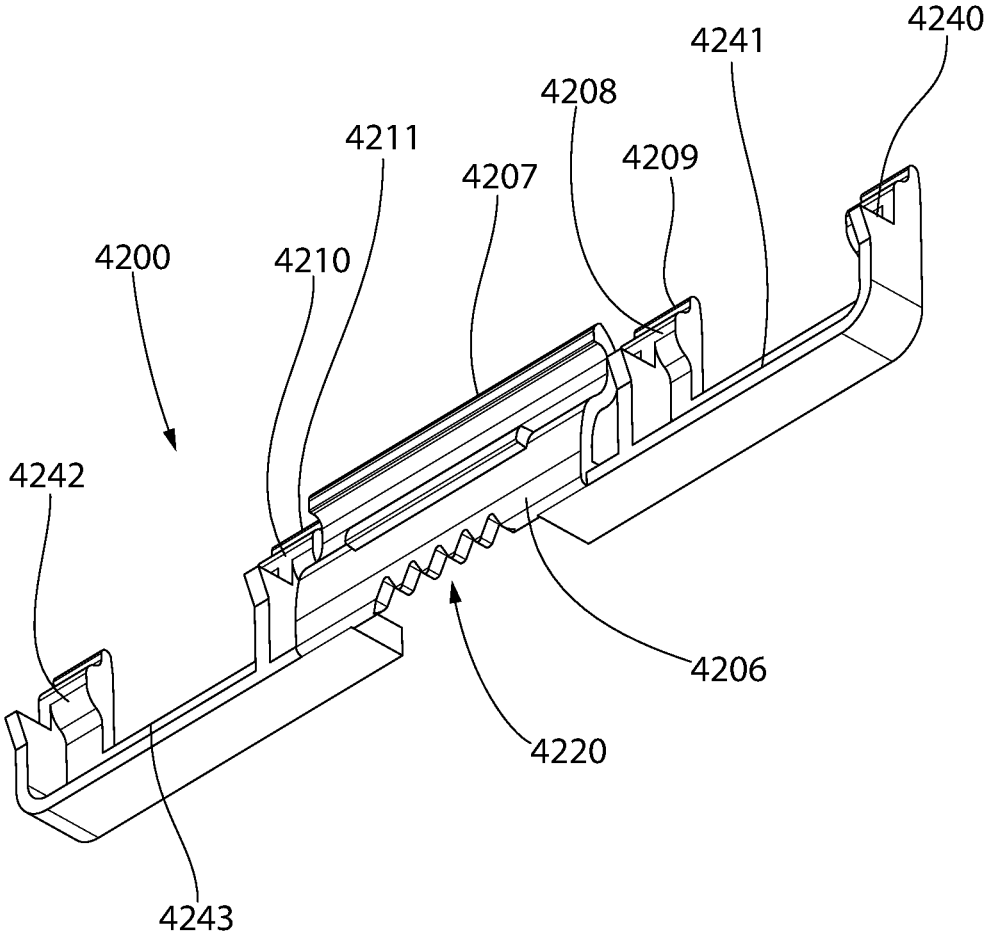
FIG. 15 is a top perspective view of the clip member of FIG. 14.
Figure 16:
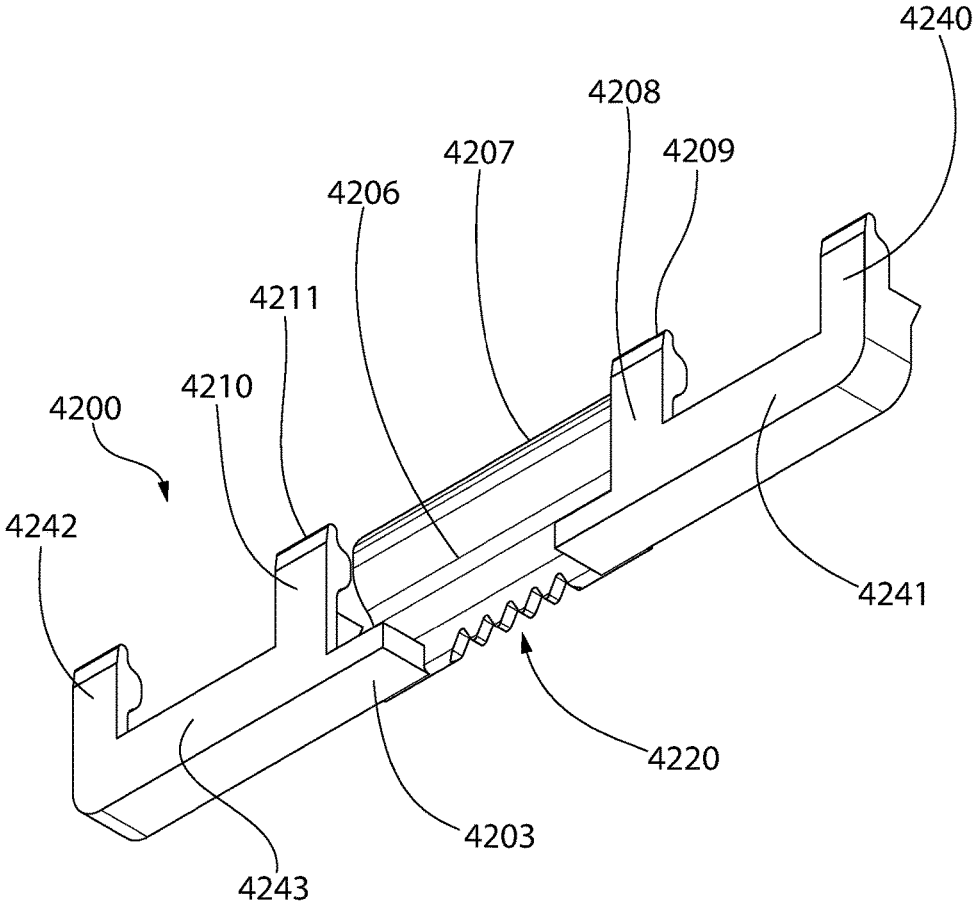
FIG. 16 is a bottom perspective view of the clip member of FIG. 14.

Referring to FIGS. 14-16, a frame apparatus 4000 and a clip member 4200 thereof is illustrated. The frame apparatus 4000 generally comprises a frame 4100 that retains a stack 4010 and one or more of the clip members 4200 detachably coupled to the frame 4100 such that the clip members 4200 are slidable within the channel of the frame 4100 when the clip members 4200 are coupled thereto. The structural details of the frame 4100 are essentially identical to those of the frame 100 described above, and thus it will not be repeated herein for brevity it being understood that the description of the frame 100 provided above is applicable. The difference between the frame apparatus 4000 and the frame apparatus 1000 is in the structure of the clip members 4200 as described below.

The clip members 4200 are similar to the clip members 200 except that they have an extended length so that they take up more of the linear length of the linear section of the channel within which they are mounted. This enables the clip members 4200 to be better suited for retaining the stack 4010 within the rabbet of the frame 4100. Thus, the clip member 4200 still has a first leg 4206 similar to the first leg 206 of the clip member 100. The first leg 4206 extends from a base portion 4203 to a distal end 4207. The edge of the first leg 4206 opposite the distal end 4207 forms a hanging feature 4220 for hanging the frame 4100 from a wall. Furthermore, the clip member 4200 has a second leg. 4208 extending from the base portion 4203 to a distal end 4209 and a third leg 4210 extending from the base portion 4203 to a distal end 4211. However, in this embodiment the second leg 4208 is connected to a fourth leg 4240 via an extender 4241 and the third leg 4209 is connected to a fifth leg 4242 via an extender 4243. The second and fourth legs 4208, 4240 and the third and fifth legs 4210, 4242 collectively form the stack retaining feature of the clip members 4200 because those legs contact the rear of the stack 4010 and secure it within the rabbet when the clip members 4200 are coupled to the frame 4100 as has been described herein above.

Figure 17:
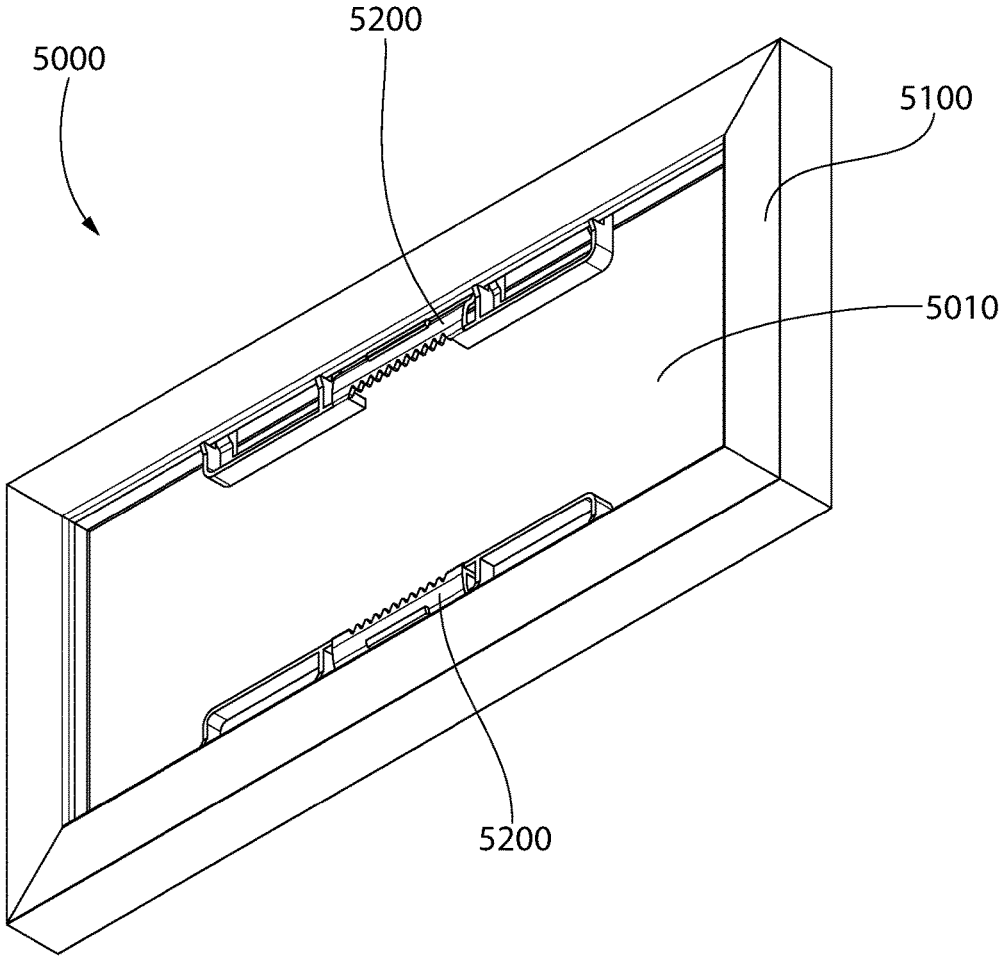
FIG. 17 is a rear perspective view of a frame apparatus having a frame and a clip member coupled thereto in accordance with another embodiment of the present invention.
Figure 18:
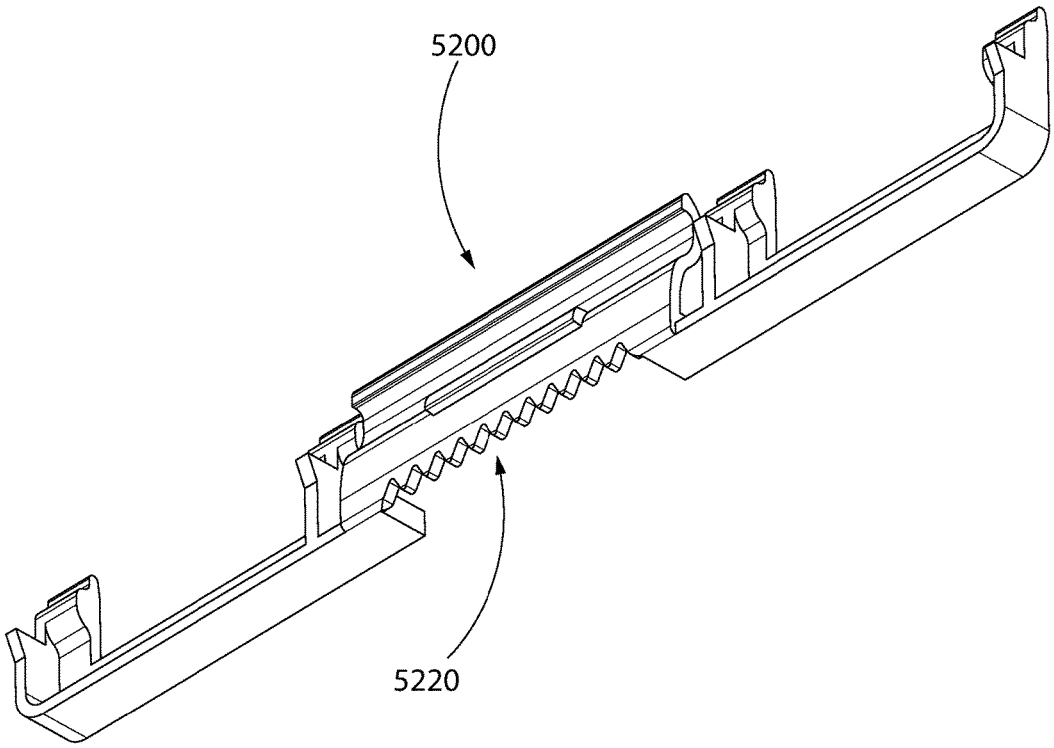
FIG. 18 is a top perspective view of the clip member of FIG. 17.
Figure 19:
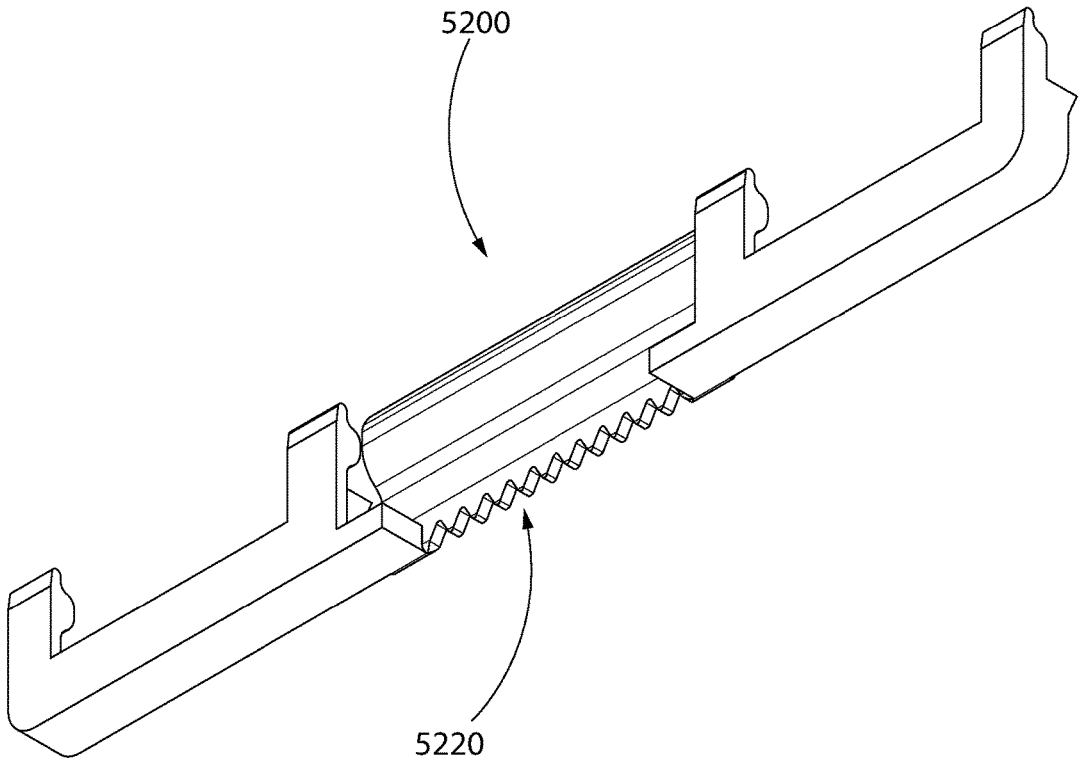
FIG. 19 is a bottom perspective view of the clip member of FIG. 17.

Referring to FIGS. 17-19, another embodiment of a frame apparatus 5000 and a clip member 5200 thereof is illustrated in accordance with the present invention. The frame apparatus 5000 generally comprises a frame 5100 that retains a stack 5010 and one or more of the clip members 5200 detachably coupled to the frame 5100 such that the clip members 5200 are slidable within the channel of the frame 5100 when the clip members 5200 are coupled to the frame 5100. The frame apparatus 5000 is identical to the frame apparatus 4000 previously described except for a minor variation in the structure of the clip members 5200, as described below.

The difference between the clip members 5200 and the clip members 4200 is that the length of each of the legs is increased. Thus, the structure of the clip member 5200 is identical to the structure of the clip member 4200, except each feature is longer. This again provides a potential for increased retention of the stack 5010 within the rabbet of the frame 5100. Furthermore, this increases the length of the hanging feature 5220 which better enables a user to ensure that a part of the hanging feature 5220 comes into contact with a hanging element protruding from a wall when it is time to hang the frame apparatus 5000 from a wall.

Although described herein as being a frame (such as one that is used to protect and display photographs or the like), the concepts described herein may also be applicable to a mirror. Thus, the stack 10 may simply be a mirror in some embodiments. Specifically, a mirror may be hung from a wall or vertical surface using one of the clip members described herein to facilitate a level hanging of the mirror. Such a mirror might be placed within a frame, and the clip members would be coupled to the frame in a similar manner to that which has been described herein above. Furthermore, any other apparatus aside from frames and mirrors, including without limitation shelves, storage boxes, cabinets, or the like that may be desirable to hang from a wall may be used in conjunction with the clip members described herein to facilitate a level hanging of that apparatus or object.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A frame apparatus for displaying an article, the frame apparatus comprising:

a frame comprising:

an inner surface defining a display opening; and a rabbet defined by a floor and a wall of the frame, a channel formed into the wall;

a stack comprising a front surface and an opposite rear surface positioned in the rabbet and extending across the display opening;

a spring clip slidably coupled to the frame within the channel and trapping the stack between the spring clip and the floor of the rabbet, the spring clip comprising a hanging feature for hanging the frame;

wherein the spring clip comprises a base portion, a first leg extending from the base portion to a distal end, and a second leg extending from the base portion to a distal end, the distal ends of the first and second legs positioned within the channel to slidably couple the spring clip to the frame; and wherein the channel is defined by a top surface, a bottom surface, and a sidewall surface extending between the top and bottom surfaces, and further comprising a protrusion extending from the top surface and into the channel, and wherein when the spring clip is coupled to the frame the protrusion nests within a depression in the first leg of the spring clip and the second leg of the spring clip is in contact with the bottom surface of the channel.

2. The frame apparatus of claim 1 wherein the distal ends of the first and second legs are free ends that are spaced apart from one another, and wherein at least one of the first and second legs is pivotable relative to the base portion of the spring clip.

3. The frame apparatus of claim 1 wherein the protrusion comprises a leading edge comprising a chamfer and a trailing edge, and wherein a distal portion of the first leg of the spring clip is located between the sidewall surface of the channel and the trailing edge of the protrusion.

4. The frame apparatus of claim 1 further comprising a third leg extending from the base portion to a distal end, and wherein the first leg is located between the second and third legs.

5. A frame apparatus for displaying an article, the frame apparatus comprising:

a frame comprising:

an inner surface defining a display opening; and a rabbet defined by a floor and a wall of the frame, a channel formed into the wall;

a stack comprising a front surface and an opposite rear surface positioned in the rabbet and extending across the display opening;

a spring clip slidably coupled to the frame within the channel and trapping the stack between the spring clip and the floor of the rabbet, the spring clip comprising a hanging feature for hanging the frame; and wherein the spring clip comprises a base portion, a first leg extending from the base portion to a distal end, a second leg extending from the base portion to a distal end, and a third leg extending from the base portion to a distal end, the first leg being located between the second and third legs, the distal ends of the first and second legs positioned within the channel to slidably couple the spring clip to the frame; and wherein the base portion of the spring clip comprises a top surface and a bottom surface, and wherein the first leg extends from the base portion adjacent the top surface of the base portion and the second and third legs extend from the base portion adjacent the bottom surface of the base portion.

6. A frame apparatus for displaying an article, the frame apparatus comprising:

a frame comprising:

an inner surface defining a display opening; and a rabbet defined by a floor and a wall of the frame, a channel formed into the wall;

a stack comprising a front surface and an opposite rear surface positioned in the rabbet and extending across the display opening;

a spring clip slidably coupled to the frame within the channel and trapping the stack between the spring clip and the floor of the rabbet, the spring clip comprising a hanging feature for hanging the frame; and wherein the spring clip comprises a base portion, a first leg extending from the base portion to a distal end, and a second leg extending from the base portion to a distal end, the distal ends of the first and second legs positioned within the channel to slidably couple the spring clip to the frame; and wherein the base portion of the spring clip comprises a first section and a second section that are spaced apart from one another, and wherein the hanging feature is formed into an edge of the first leg of the spring clip that extends between the first and second sections of the base portion.

7. The frame apparatus of claim 6 wherein the hanging feature is a sawtooth hanger.

8. The frame apparatus of claim 1 wherein the second leg comprises a bottom surface that is in contact with the rear surface of the stack to retain the stack within the rabbet.

9. The frame apparatus of claim 1 wherein the channel comprises a plurality of linear sections, and wherein at least one of the spring clips is positioned in at least two opposing and non-adjacent ones of the linear sections.

10. A frame apparatus for displaying an article, the frame apparatus comprising:

a frame having a front surface and an opposite rear surface, the frame comprising:

an inner surface defining a display opening;

a rabbet defined by a floor and a wall of the frame; and a channel formed into the wall and defined by a bottom surface, a top surface, and a sidewall surface;

a stack positioned in the rabbet and extending across the display opening; and a clip member slidably coupled to the frame with a first portion of the clip member located within the channel and a second portion of the clip member protruding from the channel, wherein the stack is compressed between the second portion of the clip member and the floor of the rabbet, the second portion of the clip member having a hanging feature for hanging the frame;

wherein the clip member comprises a first leg terminating in a distal end and a second leg terminating in a distal end, each of the first and second legs extending from a common base portion to their respective distal ends, and wherein at least one of the first and second legs is pivotable relative to the common base portion; and a protrusion extending from the top surface of the channel in a direction of the bottom surface of the channel, the protrusion having a leading edge adjacent the inner surface of the frame and an opposite trailing edge, and wherein the clip member is coupled to the frame via engagement between a distal portion of the first leg of the clip member and the trailing edge of the protrusion when the first portion of the clip member is located within the channel.

11. The frame apparatus of claim 10 wherein the clip member can slide relative to the frame while remaining coupled to the frame.

12. The frame apparatus of claim 10 wherein the first leg comprises a depression within which the protrusion nests when the clip member is slidably coupled to the frame.

13. The frame apparatus of claim 10 wherein the second leg comprises a bottom surface that is in contact with the rear surface of the stack to compress the stack within the rabbet, wherein the common base portion of the spring clip comprises a first section and a second section that are spaced apart from one another, and wherein the hanging feature is formed into an edge of the first leg of the spring clip that extends between the first and second sections of the common base portion.

14. The frame apparatus of claim 10 wherein a portion of the rabbet defined between the floor of the rabbet and the bottom surface of the channel has a depth, and wherein the stack has a thickness that is equal to or greater than the depth of the portion of the rabbet.

* * * * *